US010934897B2

(12) United States Patent
Kameda et al.

(10) Patent No.: US 10,934,897 B2
(45) Date of Patent: Mar. 2, 2021

(54) MECHANICAL LASH ADJUSTER

(71) Applicant: NITTAN VALVE CO., LTD., Hadano (JP)

(72) Inventors: Michihiro Kameda, Ota (JP); Hiroyuki Ozawa, Hadano (JP); Masaaki Inoue, Hadano (JP)

(73) Assignee: NITTAN VALVE CO., LTD., Hadano (JP)

( * ) Notice: Subject to any disclaimer, the term of this patent is extended or adjusted under 35 U.S.C. 154(b) by 0 days.

(21) Appl. No.: 16/308,805

(22) PCT Filed: Jun. 17, 2016

(86) PCT No.: PCT/JP2016/068045
§ 371 (c)(1),
(2) Date: Dec. 10, 2018

(87) PCT Pub. No.: WO2017/216946
PCT Pub. Date: Dec. 21, 2017

(65) Prior Publication Data

US 2019/0316495 A1 Oct. 17, 2019

(51) Int. Cl.
*F01L 1/22* (2006.01)
*F01L 1/14* (2006.01)
*F01L 1/18* (2006.01)

(52) U.S. Cl.
CPC ..... *F01L 1/22* (2013.01); *F01L 1/143* (2013.01); *F01L 1/181* (2013.01); *F01L 1/185* (2013.01); *F01L 2305/02* (2020.05)

(58) Field of Classification Search
CPC . F01L 1/25; F01L 1/143; F01L 1/0532; F01L 13/0036; F01L 1/053; F01L 1/16; F01L 1/14; F01L 1/22; F01L 1/185
(Continued)

(56) References Cited

U.S. PATENT DOCUMENTS 1,421,783 A * 7/1922 Jerdone, Jr. ..... F01L 1/22 123/90.53
1,634,276 A * 7/1927 Stevenson ..... F01L 1/14 123/90.52
(Continued)

FOREIGN PATENT DOCUMENTS

JP S61-502553 A 11/1986
JP H3-1203 U 1/1991
(Continued)

OTHER PUBLICATIONS

International Search Report dated Apr. 10, 2007 in International Application No. PCT/JP2006/326221 filed on Dec. 28, 2006, the national stage of which was U.S. Appl. No. 12/515,408, which issued as U.S. Pat. No. 7,954,468 on Jun. 7, 2011, and which published as WO 2008/081534 A1 on Jul. 10, 2008 and as US 2010 0050969 A1 on Mar. 4, 2010.
(Continued)

*Primary Examiner* — Patrick Hamo
*Assistant Examiner* — Wesley G Harris
(74) *Attorney, Agent, or Firm* — JTT Patent Services, LLC; Gerald T. Peters

(57) ABSTRACT

Provided is a mechanical lash adjuster including a plunger, a housing put into thread engagement with the plunger in an axial direction to form a thread engagement portion, the plunger engaging member fixed and retained in a circumferential direction of the thread engagement portion, and a coil spring urging the plunger in a direction opposite to a urging-force acting direction of a coil spring. A lead and flank angles of threads forming the thread engagement portion are set such that when an axial load acts on the plunger in either of a plunger extension and contraction directions, the plunger is made self-sustaining, and when the plunger swings by an amount corresponding to a backlash due to a lateral load, the plunger slides and rotates at the
(Continued)

thread engagement portion to move in an axial-load acting direction.

4 Claims, 10 Drawing Sheets

(58) Field of Classification Search
USPC ..... 123/90.27, 90.48, 90.54
See application file for complete search history.

(56) References Cited

U.S. PATENT DOCUMENTS

| | | | | | |
|---|---|---|---|---|---|
| 1,817,620 | A * | 8/1931 | Hamilton | F01L 1/22 | 123/90.54 |
| 1,983,127 | A * | 12/1934 | Fredrickson | F01L 1/22 | 123/90.54 |
| 2,066,976 | A * | 1/1937 | Holmes | F01L 1/22 | 123/90.54 |
| 2,222,138 | A * | 11/1940 | Burkhardt | F01L 1/22 | 123/90.54 |
| 2,308,858 | A * | 1/1943 | Burkhardt | F01L 1/22 | 123/90.49 |
| 2,821,179 | A | 1/1958 | Oldberg | | |
| 4,706,620 | A | 11/1987 | Gill | | |
| 4,981,117 | A | 1/1991 | McRobert | | |
| 6,834,628 | B2 | 12/2004 | Duesmann | | |
| 7,954,468 | B2 | 6/2011 | Kameda | | |
| 8,136,493 | B2 | 3/2012 | Yamaguchi et al. | | |
| 2003/0075131 | A1 | 4/2003 | Gill | | |
| 2010/0050969 | A1* | 3/2010 | Kameda | F01L 1/02 | 123/90.45 |
| 2010/0288219 | A1 | 11/2010 | Yasui et al. | | |
| 2011/0005484 | A1* | 1/2011 | Yasui | F01L 1/143 | 123/90.54 |
| 2015/0075470 | A1 | 3/2015 | Kubota | | |

FOREIGN PATENT DOCUMENTS

| | | | |
|---|---|---|---|
| JP | H4-44407 | U | 4/1992 |
| JP | H11-324617 | A | 11/1999 |
| JP | 2001-124159 | A | 5/2001 |
| JP | 2005-291153 | A | 10/2005 |
| JP | 2006-336585 | A | 12/2006 |
| JP | 2007-154852 | A | 6/2007 |
| JP | 2009-299550 | A | 12/2009 |
| WO | 2001/57367 | A2 | 8/2001 |
| WO | 2008/081534 | A1 | 7/2008 |
| WO | 2013/136508 | A1 | 9/2013 |
| WO | 2016/035373 | A1 | 3/2016 |

OTHER PUBLICATIONS

Extended European Search Report, dated Feb. 18, 2011, in EP 06843599, which is EP counterpart of PCT/JP2006/326221.

International Search Report dated Jun. 19, 2012 in International Application No. PCT/JP2012/056841 filed on Mar. 2012, the national stage of which was U.S. Appl. No. 14/385,427, which issued as U.S. Pat. No. 9,175,580 on Nov. 3, 2015, and which published as WO 2013/136508 A1 on Sep. 19, 2013 and as US 2015 0075470 A1 on Mar. 19, 2015.

Development of the End-Pivot Type Mechanical Lash Adjuster, pp. 78-85 and Figs. 1-4, NTN Technical Review No. 75 (2007).

Extended European Search Report, dated Nov. 26, 2019, in EP 17813387, which is EP counterpart application of PCT/JP2017/022123.

Applicant brings to the attention of the Examiner the existence of related copending U.S. Appl. No. 16/309,116 which is the national stage of International Application No. PCT/JP2017/022123 filed on Jun. 15, 2017 and published as WO 2017/217493 A1 on Dec. 21, 2017 and as US 2019 0145287 A2 on May 16, 2019, which has overlapping inventorship/ownership as in the present case.

Applicant brings to the attention of the Examiner the existence of related U.S. Pat. No. 7,954,468 issued Jun. 7, 2011 on U.S. Appl. No. 12/515/408 which was the national stage of International Application No. PCT/JP2006/326221 filed on Dec. 28, 2006 and published as WO 20081081534 A1 on Jul. 10, 2008 and as US 2010 0050969 A1 on Mar. 4, 2010, which has overlapping inventorship/ownership as in the present case.

Applicant brings to the attention of the Examiner the existence of related U.S. Pat. No. 9,175,580 issued Nov. 3, 2015 on U.S. Appl. No. 14/385/427 which was the national stage of International Application No. PCT/JP20121056841 filed on Mar. 16, 2012 and published as WO 2013/136508 A1 on Sep. 19, 2013 and as US 2015 0075470 A1 on Mar. 19, 2015, which has overlapping inventorship/ownership as in the present case.

* cited by examiner

MECHANICAL LASH ADJUSTER

CROSS-REFERENCE TO RELATED APPLICATION AND INCORPORATION BY REFERENCE

This application is the national stage of International Application No. PCT/JP2016/068045, entitled "Mechanical Lash Adjuster", filed 17 Jun. 2016, the content of which is incorporated herein in its entirety by reference.

TECHNICAL FIELD

The present invention relates to a valve mechanism automatically adjusting a valve clearance (a distance between a cam and a valve stem e.g., a gap between a valve stem and a rocker arm in a rocker-arm valve mechanism or a gap between a valve stem and a plunger in a direct-acting valve mechanism). In particular, the present invention relates to a mechanical lash adjuster including a plunger in which a pressing force of a cam acts as an axial load, a plunger engaging member retained so as to be put into thread engagement with the plunger in the axial direction not to rotate in the circumferential direction of the thread engagement portion.

BACKGROUND

It is widely known that when an intake valve or an exhaust valve used in an engine of an automobile etc. is mounted on an intake port or an exhaust port of a cylinder head, for example, a rocker arm linked to a valve stem is configured to swing by using a mechanical lash adjuster as a fulcrum, so as to automatically adjust a valve clearance through driving (extension/contraction motion) of the mechanical lash adjuster (e.g., see Patent Documents 1, 2, and Non-Patent Literature 1).

This type of mechanical lash adjuster includes a cylindrical housing serving as a plunger engagement member, the housing having a female thread inside thereof, a pivot member having a male thread on the exterior with a lower portion of the pivot member retained in the housing and a plunger spring (compression coil spring) accommodated in the housing, the plunger spring urging the pivot member toward a rocker arm on the upper side. By setting angles (lead and flank angles) of "thread ridges" of "buttress threads" made up of a female thread on the housing side and a male thread on the pivot member side to predetermined angles, the pivot member is allowed to slide and rotate at the thread engagement portion and thereby moved in a direction in which the pivot member projects from the housing (hereinafter referred to as a "pivot member extension direction") under an axial load in the same direction, while the slide rotation of the plunger is suppressed in the thread engagement portion (hereinafter, this will be referred to as "threads" being made self-sustaining) by a friction generated in the thread engagement portion in a direction in which the plunger sinks into the housing (hereinafter referred to as a "pivot member contraction direction") under an axial load in the same direction, and the valve clearance is thereby automatically adjusted.

CITATION LIST

Patent Literatures

Patent Literature 1: Japanese Unexamined Patent Application Publication S61-502553 (FIGS. 1-5)

Patent Literature 2: Japanese Unexamined Utility Model Application Publication H3-1203 (FIGS. 1-3)

Patent Literature 3: International Publication No. WO2013/136508A

Non-Patent Literature

Non-patent Literature 1: NTN TECHNICAL REVIEW, No. 75 (2007), pp 78-85, FIGS. 1-4, "Development of End-Pivot Type Mechanical Lash Adjuster".

SUMMARY OF INVENTION

Technical Problem

However, while the conventional mechanical lash adjusters (Patent Literatures 1, 2, and Non-Patent Literature 1) can operate in the direction of reducing the valve clearance (the pivot member extension direction) when the valve clearance is increased, the mechanical lash adjusters have no adjusting structure actively increasing the valve clearance (adjusting the valve clearance to zero) in the operation in the direction of increasing the valve clearance (the pivot member contraction direction) when the valve clearance is reduced, although having a margin for adjustment of thread backlash (backlash).

In particular, FIG. 11 is an enlarged view of a male thread (buttress thread) of a pivot member constituting a conventional mechanical lash adjuster. It is noted that a lead angle $\alpha'$ of "thread ridge" of the male thread on the pivot member is set to a predetermined angle, for example, 15 degrees so as to allow the pivot member to slide and rotate at a thread engagement portion under an axial load acting in either of pivot member extension direction (upward in FIG. 11) and pivot member contraction direction (downward in FIG. 11).

An upper flank angle $\theta 2$ is also set, in association with the lead angle $\alpha'$ of the thread ridge, to a predetermined angle (for example 15 degrees) so as to allow the pivot member to slide and rotate at the thread engagement portion under an axial load acting in the pivot member extension direction. On the other hand, the lower flank angle $\theta 1$ is set, in association with the lead angle $\alpha'$ of the thread ridge, to a predetermined angle (for example 75 degrees) so as to "make the thread self-sustaining" in virtue of a friction torque generated in the thread engagement portion under an axial load acting in the pivot member contraction direction.

As a consequence, when a valve clearance increase, the pivot member can slide and rotate at the thread engagement portion in virtue of a spring force of the plunger spring to move in the pivot member extension direction (a direction to decrease the valve clearance). However, when the valve clearance decrease, the pivot member cannot slide and rotate to move in the pivot member contraction direction (a direction to increase the valve clearance) due to a large frictional torque generated in the thread engagement portion.

For example, in the event where a heated engine is stopped and then cooled rapidly, the valve clearance may become excessively small (negative clearance) so that a valve seat may levitate off a valve seat insert, due to the difference in the thermal expansion coefficient between a cylinder head (aluminum alloy) and a valve (ferrous alloy). Also, in the event where the surface of the valve seat insert is worn away, the same may occur (the valve seat may levitate off the valve seat insert).

Under such circumstances, since the pivot members of the conventional lash adjusters cannot operate in the pivot member contraction direction (in a direction to increase valve clearance), the excessively small valve clearance (negative clearance) is left uncorrected, rendering the valve lift excessively large at the time of re-stating the cold engine and sealing ability of the valve seat face with the valve seat insert (or, the sealing efficiency of the combustion chamber) worsen.

The inventors wondered if friction torque generated on a position other than the thread engagement portion in the pivot member, for example, a sliding contact surface of the pivot member with an axial-load transmitting member such as a rocker arm can prevent the pivot member from sliding rotation in the thread engagement portion of the pivot member with the plunger engaging member (housing), instead of the conventional "buttress threads" in which "the threads is made self-sustaining" in virtue of the friction torque generated in the thread engagement portion constituting the male and female threads under the axial load in the pivot member contraction direction.

In other words, even when an axial load acts on the pivot member in either of extension and contraction directions, "the threads are not made self-sustaining, so that the pivot member slides and rotates at the thread engagement portion. However, when angles (a lead angle and flank angles) of the "thread ridges" of the "threads" constituting the thread engagement portion are set such that the pivot member is restrained from sliding and rotating at the thread engagement portion (hereinafter this condition will be referred to as "pivot member is made immovable at the thread engagement portion") due to friction torque generated mainly on the sliding contact surface of the pivot member with an axial-load transmitting member (for example rocker arm), the pivot member of the lash adjuster functions as a fulcrum of the swinging (opening/closing operation of the valve) in association with rotation of a cam shaft in the state where the pivot member is made immovable in the thread engagement portion, (i.e., the state where the pivot member stands still in the axial direction). In a state other than the state where the pivot member is made immovable at the thread engagement portion, the pivot member moves not only in the pivot member extension direction (in the direction to decrease the valve clearance), but also in the pivot member contraction direction (in the direction to increase a valve clearance) in which the conventional lash adjuster does not move.

The international application No. PCT/2012/056841 was filed for an invention "even when an axial load acts on the plunger in either of extension and contraction directions, the plunger is allowed to slide and rotate at the thread engagement portion to move in an axial-load acting direction, and when the sum of friction torque generated on a sliding contact surface of the plunger with an axial-load transmitting member and friction torque generated on a sliding contact surface of the plunger with a plunger spring exceeds thrust torque causing the plunger to slide and rotate at the thread engagement portion, angles (a lead angle and flank angles) of the "thread ridges" of the "threads" constituting the thread engagement portion are set such that the threads in the thread engagement portion are made self-sustaining, (for example, the lead angle and the flank angles are respectively set in the range of 10 to 40 degrees and in the range of 5 to 45 degrees)". This application has been already published as Patent Literature 3.

After the inventors continued experiments on the mechanical lash adjuster according to Patent Document 3, they found the following new problem.

In an excessively small state of valve clearance generated in the event where an engine is rapidly cooled after being stopped in a warmed state or the valve seat insert face is worn away, the plunger should sink so as to eliminate the excessively small state of valve clearance by a proper amount to a predetermined position at which the sum of the friction torque generated on the sliding contact surfaces of the plunger with the axial-load transmitting member and of the plunger with the plunger spring exceeds the thrust torque causing the plunger to slide and rotate at the thread engagement portion. However, the plunger sinks more than the proper amount, causing an unexpected state (new problem) in which a ramp (a part for adjusting acceleration of a valve) between a base circle and a cam nose of a cam fails to function, resulting in a hitting noise of the cam nose hitting the axial-load transmitting member or a collision noise of a face surface (seat) of a head colliding with a valve seat insert.

As a result of studies by the present inventors on the cause of the above problem, it was found that while a backlash (gap between male and female threads) is always provided between the male and female threads constituting the thread engagement portion, the backlash is the cause of the "excessive sinking amount of the plunger".

Specifically, for example, in a rocker-arm valve mechanism in which a pressing force of a cam acts on a plunger via a rocker arm while a contact point between the cam and the rocker arm moves on the rocker arm, a lateral load (see reference numerals T1, T2 of FIG. 5) acts on the plunger in the lateral direction relative to the axis due to a change in the acting direction of the pressing force of the cam, in addition to the axial load along the axis of the plunger. When the lateral load acts on the plunger, the plunger swings in the lateral-load acting direction by an amount corresponding to the backlash (the gap between the male and female threads) of the thread engagement portion and since the plunger moves in the axial-load acting direction while sliding and rotating due to this swing of the plunger, the plunger sinks more than an assumed sinking amount.

Against the new problem, if the backlash of the thread engagement portion is made as small as possible so that the influence of the lateral load acting on the plunger can be ignored, that is, if the backlash is so small that no moment occurs in the thread engagement portion due to the swing of the plunger, the sinking amount of the plunger in the thread engagement portion becomes proper, and the lash adjuster appropriately operates to eliminate the excessively small state of the valve clearance. However, it is extremely difficult to perform threading of the male and female threads constituting the thread engagement portion such that the backlash becomes small, and it is substantially difficult to guarantee constant quality of mass-produced lash adjusters.

Consequently, the inventors conceived a totally new structure instead of the improvement of the invention previously proposed in Patent Literature 3. The new structure includes that "the plunger slides and rotates at the thread engagement portion by rather actively utilizing the backlash present in the thread engagement portion," though based on the fact that the "threads" in the thread engagement portion is made self-sustaining under the axial load acting on the plunger.

In other words, the new structure includes "when an axial load acts on the plunger in either of extension and contraction directions, the plunger is restrained due to a frictional torque generated in the thread engagement portion so as not to slide and rotate at the thread engagement portion so that "the threads are made self-sustaining". However, when the lateral load acts on the plunger, the plunger swings in the lateral-load acting direction by an amount corresponding to the backlash in the thread engagement portion. the sum of friction torque generated on the sliding contact surface of the plunger with an axial-load transmitting member and friction torque generated on the sliding contact surface of the plunger with a plunger spring exceeds the thrust torque causing the plunger to slide and rotate at the thread engagement portion. This swinging of the plunger generates a moment to slide and rotate the plunger in the thread engagement portion, thereby the plunger moves in the axial-load acting direction".

The above-described characteristic operation of the plunger "during the swing of the plunger due to the lateral load, the plunger slides and rotates at the axial-load acting direction" is achieved by "setting the lead and the flank angles of the "thread ridges" of the "threads" constituting the thread engagement portion between the plunger and the plunger engaging member in the predetermined range". That is, setting the lead angle and the flank angles in the predetermined range allows the plunger on which the axial load acts, to be essentially immovable in the thread engagement portion (be in the form that the threads in the thread engagement portion are made self-sustaining) to function as a fulcrum of the swinging operation of the rocker arm (the opening/closing operation) in association with the rotation of the cam. In addition, for example, when a lateral load acts on the plunger via the rocker arm, the plunger slides and rotates at the plunger extension direction (a direction for decreasing the valve clearance), as well as in the plunger contraction direction (a direction in which the valve clearance increase.)

Then, the inventors made a prototype of this novel mechanical lash adjuster and verified its effect. As a result of confirmation of its effectivity, the inventors have reached the present application.

The present invention is made in view of the above problem in the conventional art. An object thereof is to provide a mechanical lash adjuster capable of automatically adjusting a valve clearance and having a different structure from the conventional art.

Solution to Problem

In order to solve the above problem, a mechanical lash adjuster according to a first embodiment of the present invention includes a plunger on which a pressing force of a cam in a valve mechanism acts as an axial load, a plunger engaging member put into thread engagement with the plunger in an axial direction to form a thread engagement portion, the plunger engaging member retained so as not to rotate in a circumferential direction of the thread engagement portion, and a plunger spring urging the plunger in an opposite direction to a direction in which a urging force of a valve spring acts. The mechanical lash adjuster interposed between a stem end of a valve urged in a valve closing direction by the valve spring and the cam to adjust a valve clearance. A lead angle and flank angles of thread ridges of threads forming the thread engagement portion are set such that when an axial load acts on the plunger in either of a plunger extension and a plunger contraction direction, the plunger is prevented from sliding and rotating due to friction torque generated in the thread engagement portion so that the threads are made self-sustaining (that is the plunger become immovable in the thread engagement portion), and when a lateral load acts on the plunger, the plunger is allowed to slide and rotate at the thread engagement portion to move in an axial-load acting direction.

It should be noted that the mechanical lash adjuster includes a mechanical lash adjuster for a rocker-arm valve mechanism which is intermediately interposed between a valve stem end and a cam via a rocker arm, and a mechanical lash adjuster for a direct-acting valve mechanism directly interposed between the valve stem end and the cam.

That is, in the former (the lash adjuster for a rocker-arm valve mechanism), a pressing force of the cam and an urging force of the valve spring act on (the plunger of) the lash adjuster via the rocker arm, whereas, in the latter (the lash adjuster for a direct-acting valve mechanism), the pressing force of the cam and the urging force of the valve spring directly act on (the plunger and the plunger engaging member of) the lash adjuster.

Apart from the specifications regarding valve mechanism, the lash adjuster may have the following first structure and second structure depending on whether the male thread (female thread) forming the thread engagement portion is formed on the plunger or the plunger engaging member.

That is, as described in EMBODIMENTs 1, 2, and 4, it can be proposed a first structure (see FIGS. 1, 6, 8) including a cylindrical housing serving as a plunger engaging member with a female thread inside thereof; the housing retained so as not to rotate in the circumferential direction; a plunger with a male thread outside thereof engaging with the female thread, the plunger put into thread engagement with the housing in the axial direction; and a plunger spring accommodated in the housing, the plunger spring urging the plunger in the opposite direction to an urging-force acting direction of the valve spring.

Further, as described in Embodiment 3, it can be proposed a second structure (see FIG. 7) including: a rod member serving as a plunger engaging member with a male thread outside thereof, the rod member retained so as not to rotate in the circumferential direction; a plunger with a female thread inside thereof engaging with the male thread, the plunger put into thread engagement with the rod member in the axial direction; and a plunger spring interposed between the rod member and the plunger, the plunger spring urging the plunger in the opposite direction to an urging-force acting direction of the valve spring.

(Function of Invention) Rotation of the cam (cam shaft) applies an axial load (a pressing force of the cam, i.e., resultant of a reaction force of the valve spring and a reaction force of the plunger spring) on the plunger of the lash adjuster configuring the valve mechanism. The axial load generates thrust torque to make the plunger slide and rotate at the thread engagement portion and friction torque to restrain the sliding rotation of the plunger.

However, the lead angle and the flank angles of the thread ridges of the "threads" forming the thread engagement portion are set such that the plunger is restrained so as not to slide and rotate at the thread engagement portion in virtue of the friction torque generated in the thread engagement portion and "the threads are made self-sustaining" when the axial load acts on the plunger in either of extension and contraction direction. Accordingly, during engine operation (during the valve opening/closing operation), basically the plunger does not slide and rotate at the thread engagement portion (the plunger does not move in the axial-load acting direction) to become immovable. For example, the plunger functions as a fulcrum of swing of the rocker arm serving as a axial-load transmitting member.

Further, for example, in the rocker-arm valve mechanism in which a pressing force of the cam acts on the plunger via a rocker arm, a contact point of the cam and the rocker arm moves on the rocker arm to change the direction of the pressing force of the cam. Accordingly, a lateral load also acts on the plunger in addition to the axial load.

Then, when the lateral load acts on the plunger retained immovable without sliding and rotating at the thread engagement portion, the plunger swings in the lateral-load acting direction by an amount corresponding to a backlash of the thread engagement portion. The swing of the plunger with respect to the plunger engaging member which is stopped rotating in the circumferential direction of the thread engagement portion moves the contact point of the male thread with the female thread. Since the lateral-load acting direction and the direction of the movement of the contact point do not coincide, the movement of the contact point acts as a moment to slide and rotate the plunger at the thread engagement portion. Thereby, the plunger slides and rotates to move in the lateral-load acting direction.

For example, as indicated by an arrow F1 in FIG. 3, when the axial load acts on the plunger 24 upward (e.g., in a form in which only the urging force of the plunger spring 26 acts on the plunger 24), an upper flank face 25*a* of the plunger-side male thread 25 comes into contact with a lower flank face 23*b* of the housing-side female thread 23. The contact point is denoted by reference characters P1. For example, it is assumed the case where the lateral load acts on the upper end of the plunger arranged in the vertical direction. That is, it is assumed that the lateral load T (see FIG. 4) inputs in a direction of from the nearside toward the far side of the sheet of FIG. 3 when the plunger 24 is viewed from outside.

In FIG. 3, the plunger 24 swings in the lateral-load T acting direction of a direction from the near side toward the far side of the sheet by using the lower end of the thread engagement portion (plunger lower end 24*b* in FIG. 1) as a fulcrum. When the thread engagement portion is a normal right-hand thread, the upper flank face 25*a* of the male thread 25 in the left half of the plunger-side male thread 25 operates to push the lower flank face 23*b* of the female thread 23 extending diagonally downward while turning clockwise. On the other hand, in the right half of the plunger-side male thread 25, the upper flank face 25*a* of the male thread 25 operates in the direction away from the lower flank face 23*b* of the female thread 23 extending diagonally upward while turning counter-clockwise.

Since the housing-side female thread 23 is retained so as not to rotate in the circumferential direction of the thread engagement portion, the contact point P1 of the upper flank face 25*a* in the left half of the male thread 25 with the lower flank face 23*b* of the housing-side female thread 23 moves in the direction along the lower flank face 23*b* of the female thread 23 diagonally extending upward while turning counter-clockwise.

Since the lateral-load T acting direction does not coincide with a moving direction of the contact point P1, the movement of the contact point P1 acts as a moment for sliding and rotating the plunger at the thread engagement portion. Thereby, the plunger 24 moves in the axial load F1 acting direction (upward) by an amount corresponding to the backlash, while sliding and rotating.

In other words, in the left half of the plunger 24, as illustrated in FIG. 4(*a*), during the swing of the plunger 24, the upper flank face 25*a* of the plunger-side male thread 25 comes into contact with the lower flank face 23*b* of the housing-side female thread 23 retained so as not to rotate in the circumferential direction and can no longer operate (no longer move leftward in FIG. 4(*a*)). On the other hand, in the right half of the plunger 24, as illustrated in FIG. 4(*b*), during the swing of the plunger 24, the upper flank face 25*a* of the plunger-side male thread 25 moves away from the lower flank face 23*b* of the housing-side female thread 23 (moves rightward in FIG. 4(*b*)) and can move without any restraint. Consequently, the plunger 24 moves in the extension direction while sliding and rotating in the counter-clockwise direction R1 by an amount corresponding to the backlash.

For example, when the thread engagement portion (the plunger-side male thread 25) is a normal right-hand thread and the axial load F1 acting on the plunger 24 is upward, the plunger 24 does not fail to rotate in the counter-clockwise direction R1 to move in the axial-load F1 acting direction (upward).

By contrast, as indicated by an arrow F2 in FIG. 3, when the axial-load acting direction on the plunger 24 is downward (e.g., in a form in which the urging force of the valve spring 14 acts on the plunger 24 via the rocker arm 16), a lower flank face 25*b* of the male thread 25 comes into contact with an upper flank face 23*a* of the female thread 23. A contact point is denoted by reference numeral P2. When the lateral load T acts on the tip end of the plunger 24 (pivot portion 24*a*) from the near side toward the far side of the sheet, the plunger 24 uses a lower end portion (a plunger lower end portion 24*b* illustrated in FIG. 1) of the thread engagement portion as a fulcrum such that the tip of the plunger 24 swings from the near side toward the far side of the sheet of FIG. 3.

When the thread engagement portion (the plunger-side male thread 25) is a normal right-hand thread, in the right half of the male thread 25, the lower flank face 25*b* of the male thread 25 operates in the direction in which the lower flank face 25*b* of the male thread 25 pushes the upper flank face 23*a* of the female thread 23 extending diagonally upward while turning counter-clockwise. On the other hand, in the left half of the male thread 25, the lower flank face 25*b* of the male thread 25 operates in a direction away from the upper flank face 23*a* of the female thread 23 extending diagonally downward while turning clockwise.

Since the housing-side female thread 23 is retained so as not to rotate in the circumferential direction, the contact point P2 of the lower flank face 25*b* in the right half of the plunger-side male thread 25 with the upper flank face 23*a* of the housing-side female thread 23 moves along the upper flank face 23*a* of the female thread 23 extending diagonally downward while turning clockwise.

In this case, since the lateral-load T acting direction does not coincide with the direction of the movement of the contact point P2, the movement of the contact point P2 acts as a moment to allow the plunger 24 to slide and rotate at the thread engagement portion. Thereby, the plunger 24 moves in the axial-load F2 acting direction (downward) while sliding and rotating by an amount corresponding to the backlash.

For example, when the thread engagement portion (plunger side male thread 25) is a normal right-hand thread and the axial load F2 acting on the plunger 24 is downward, the plunger 24 never fail to slide and rotate at the direction R2 (in the clockwise direction) to move in the axial-load-F2 acting direction (downward).

In other words, in the right half of the plunger 24, as illustrated in FIG. 4(*d*), during the swing of the plunger 24, the lower flank face 25*b* of the plunger-side male thread 25 abuts against the upper flank face 23*a* of the housing-side female thread 23 and can no longer operate (move rightward in FIG. 4(*d*)). On the other hand, in the left half of the plunger 24, as illustrated in FIG. 4(*c*), during the swing of the plunger 24, since the lower flank face 25*b* of the plunger-side male thread 25 moves away from the upper flank face 23*a* of the housing-side female thread 23, the plunger 24 can operate without any restraints (can move leftward in FIG. 4(*c*)). Consequently, the plunger 24 moves in the contraction direction while sliding and rotating in the direction R2 by an amount corresponding to the backlash.

In particular, setting the lead angle and the flank angles of the thread ridges of the "threads" forming the thread engagement portion to predetermined values basically makes the plunger on which the axial load acts relatively immovable (make the threads self-sustaining) at the thread engagement portion and function (act) as a fulcrum of the swing of the rocker arm cooperating with the rotation of the cam. When the lateral load acts on the plunger, the plunger moves by an amount corresponding to the backlash of the thread engagement portion not only in the plunger extension direction (the direction to decrease the valve clearance) but also in the plunger contraction direction (the direction to increase the valve clearance).

Specifically, as illustrated in FIG. 5, when the contact point of the rocker arm with the cam shifts from the cam circle to the cam nose, or from the cam nose to the cam circle, the lateral load acts on the plunger together with the axial load via the rocker arm. However, immediately after the start of the lift of the valve or immediately before the end of the lift, during the swing of the plunger due to the lateral load by an amount corresponding to the backlash, the contact point of the male thread with the female thread moves in the circumferential direction. The movement of the contact point acts as a moment to make the plunger to slide and rotate at the thread engagement portion. That is, the plunger slides and rotates at the thread engagement portion to move in the lateral-load acting direction by an amount corresponding to the backlash, so that the valve-clearance increasing/decreasing state is canceled.

More specifically, when the valve clearance (a gap appears between the cam and the rocker arm) increases, the lateral load acts via the rocker arm on the self-sustaining plunger on which only the urging force of the plunger spring acts as the axial load, immediately after the start of the lift of the valve or immediately before the end of the lift. In this case, during the swing of the plunger in the lateral-load acting direction, the contact point P1 moves in the thread engagement portion so that a moment is generated. Consequently, the plunger slides and rotates at the thread engagement portion to move in the plunger extension direction of the axial-load acting direction, i.e., in a direction to decrease the valve clearance, so that the valve clearance increasing state is canceled.

On the other hand, when the valve clearance is excessively small (a negative gap appears between the cam and the rocker arm), a lateral load acts via the rocker arm on the self-sustaining plunger on which only the urging force of the valve spring acts as the axial load, immediately after the start of the lift of the valve or immediately before the end of the lift. In this case, during the swing of the plunger in the lateral-load acting direction, the contact point P2 moves in the thread engagement portion so that a moment is generated. Consequently, the plunger slides and rotates at the thread engagement portion to move in the plunger contraction direction of the axial-load acting direction, i.e., in a direction to increase the valve clearance, so that the valve clearance excessively small state is canceled.

The lash adjuster according to the present invention is configured such that when the axial load acts on the plunger in either of extension and contraction directions, the slide rotation of the plunger is suppressed at the thread engagement portion by the friction torque generated in the thread engagement portion so that "the threads are made self-sustaining." Since the plunger slides and rotates at the thread engagement portion by actively utilizing the fact that the plunger swings due to the lateral load by an amount corresponding to the backlash of the thread engagement portion, it is not necessary to make the backlash smaller than that of the conventional backlash. Accordingly threading of the male and female threads constituting the thread engagement potion is made easier. Therefore, the present invention is extremely effective for mass-production of mechanical lash adjusters with constant quality guaranteed.

In claim 2, in the mechanical lash adjuster according to claim 1, angles of the thread ridges of the threads forming the thread engagement portion is set so that the lead angle is smaller than 15 degrees, and the flank angles are in the range of 5 to 60 degrees.

The "threads" forming the thread engagement portion, i.e. the male thread and the female thread, may be trapezoid screw threads or triangle screw threads. The "threads" also may be "equal flank thread" having equal upper and lower flank angles or "unequal flank thread" having upper and lower flank angles different from each other.

(Function) A substantial friction angle of the thread engagement portion is determined according to the lead angle and the flank angles of the thread ridge of the "threads" forming the tread engagement portion. If the lead angle is 15 degrees or more, the plunger on which the axial load acts slides and rotates at the thread engagement portion. Accordingly, it is difficult to "reliably make the threads self-sustaining" by the fiction torque generated in the thread engagement portion.

By contrast, when the lead angle is less than 15 degrees, the plunger on which the axial load acts does not slide and rotate at the thread engagement portion, so as to "make the threads self-sustaining" by the friction torque generated in the thread engagement portion.

Further, if the flank angles are less than 5 degrees, the threads fall into a category of a square screw having a small substantial friction angle. This makes changing the flank angle meaningless and highly-accurate machining without influence of a lead error, etc. difficult. On the other hand, even when the threads has a large lead angle generally not to "make the threads self-sustaining", the substantial friction angle of the thread engagement portion becomes large in combination with large flank angles, so that the thread functions as a self-sustaining thread. However, if the flank angles exceed 60 degrees, it is easy to machine the "thread" but it is practically impossible to use the "thread" because the substantial friction angle is extremely large to be considerably influenced by lubrication oil so that the lift loss during operation of the engine. In other words, the significance of using the flank angle as an adjustment parameter disappears.

Therefore, it is desirable to set the lead angle and the flank angles of the thread ridges of the "threads" forming the thread engagement portion respectively in a range of less than 15 degrees and in a range of 5 to 60 degrees such that the threads are reliably made self-sustaining, that is the thread engagement portion is made relatively immovable when an axial load acts on the plunger in either of the extension of contraction directions. By the way, in the thread engagement portion between a general bolt and nut mainly used for fastening, a lead angle is 2 to 3 degrees in the thread ridges. By contrast, it is desirable that in the thread engagement portion between the plunger and the plunger engaging member forming the lash adjuster used in the same way as a feed screw, the lead angle be about three to four times large as the lead angle (2 to 3 degrees) of the thread engagement portion between the bolt and nut for fastening.

In claim 3, in the mechanical lash adjuster according to claim 1 or 2, the thread engagement portion is configured such that the backlash of the thread engagement portion is constant in a axial direction of the plunger, or changes continuously or stepwise in an axial direction of the plunger.

A structure that the backlash of the thread engagement portion is constant in the axial direction corresponds to an embodiment in which an effective diameter of the male thread of the plunger and an effective diameter of the female thread of the plunger engaging member are constant in the axial direction.

An example of a structure that the backlash of the thread engagement portion changes continuously in the axial direction includes an embodiment in which an effective diameter of the male thread of the plunger is constant in the axial direction while an effective diameter of the female thread of the plunger engaging member becomes smaller (or larger) in the upper side in the axial direction, that is, the plunger engaging member is tapered with respect to the effective diameter of the female thread. Another example includes an embodiment in which an effective diameter of the female thread of the plunger engaging member is constant in the axial direction while the plunger is tapered with respect to the effective diameter of the male thread.

Further, an example of a structure that the backlash of the thread engagement portion changes stepwise in the axial direction includes an embodiment in which an effective diameter of the male thread of the plunger is constant in the axial direction while an effective diameter of the female thread of the plunger engaging member becomes stepwise smaller (or larger) in the upper side in the axial direction, or to the contrary, the effective diameter of the female thread of the plunger engaging member is constant in the axial direction while the effective diameter of the male thread of the plunger becomes stepwise smaller (or larger).

Advantageous Effect of the Invention

As apparent from the above description, with the mechanical lash adjuster according to the present invention, even when the valve clearance changes to either increase or decrease, in the valve opening/closing operation, the plunger slides and rotates by an amount corresponding to the backlash due to the lateral load acting on the plunger during the swing of the plunger at the thread engagement portion to move in a direction to cancel the change of the valve clearance. Consequently, the valve clearance can be automatically and securely adjusted.

Further, the lash adjuster according to the present invention is configured such that, when an axial load acts on the plunger in either of extension and contraction directions, the sliding rotation of the plunger in the thread engagement portion is suppressed due to the friction torque generated in the thread engagement portion to make the threads self-sustaining. Since the plunger slides and rotates at the thread engagement portion by actively utilizing the fact that the plunger swings due to the lateral load by an amount corresponding to the backlash of the thread engagement portion, it is not necessary to make the backlash smaller than that of the conventional backlash. Accordingly threading of the male and female threads forming the thread engagement potion is made easier. Therefore, the present invention is extremely effective for mass-production of mechanical lash adjusters with constant quality guaranteed.

With the lash adjuster according to claim 2, the lead angle and the flank angles of the thread ridges of the "threads" forming the thread engagement portion are set to the predetermined angle corresponding to the magnitude of the axial load and the lateral load. Accordingly, in the case of change of the valve clearance, the plunger properly and smoothly moves in a direction to cancel the change. Consequently, the valve clearance can be automatically, securely and speedy adjusted.

With the lash adjuster according to claim 3, configuring the backlash of the thread engagement portion in the lateral direction to continuously or stepwise change in the axial direction enables the backlash in the axial direction in the thread engagement portion to be substantially zero and the backlash in the lateral direction to be large. Consequently, a preferable performance for a lash adjuster can be obtained that a lift loss generated in engine operation is small and the adjustment of the valve clearance can be finished by the minimum number of rotation.

DESCRIPTION OF EMBODIMENTS

A first embodiment in which the present invention is applied to a mechanical lash adjuster for a rocker-arm valve mechanism will be described with reference to FIGS. 1 to 5.

Figure 1:
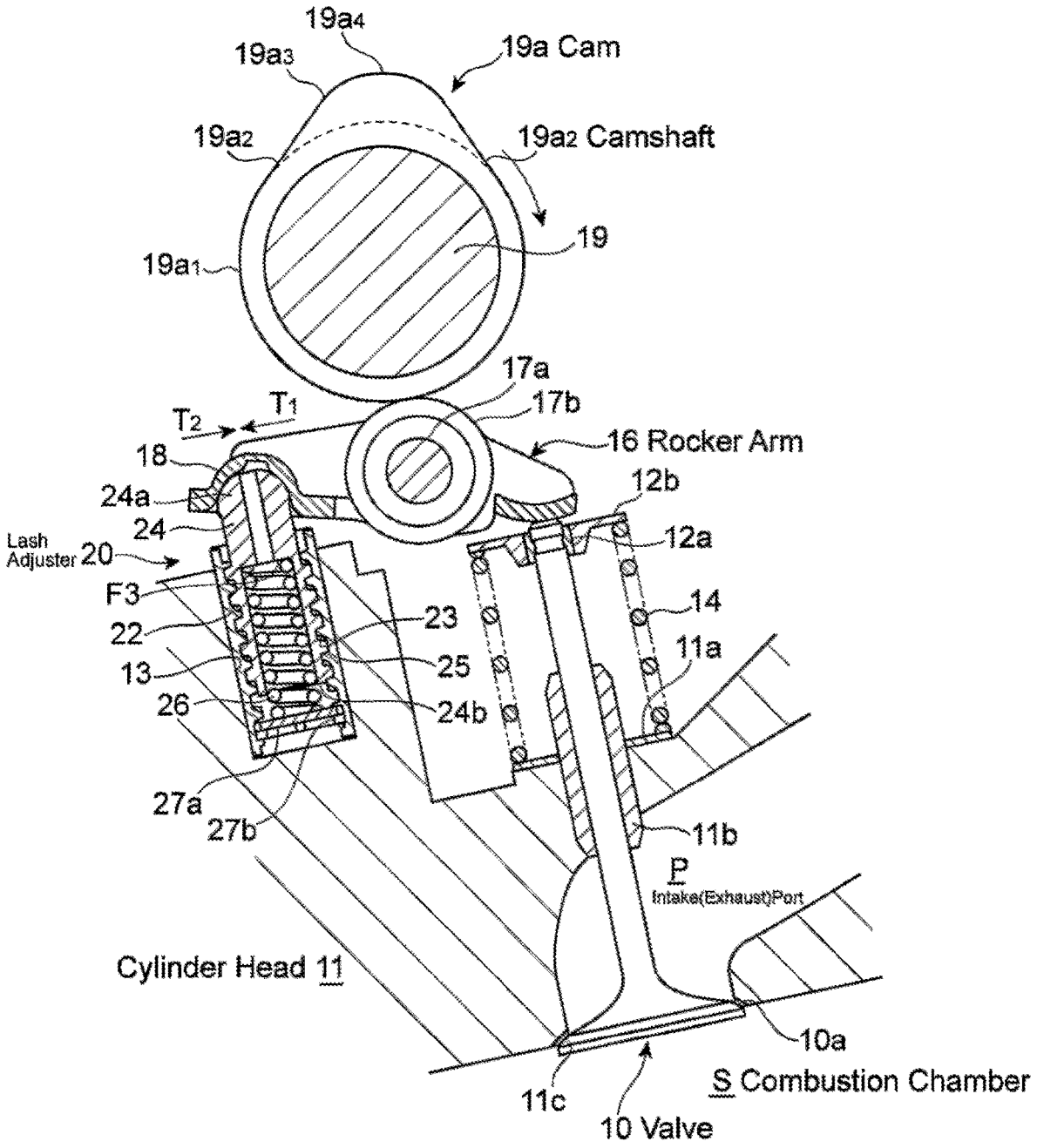
FIG. 1 is a cross-sectional view of an entire rocker-arm valve mechanism illustrating a first embodiment in which the present invention is applied to a mechanical lash adjuster of rocker-arm valve mechanism.

In FIG. 1 depicting the rocker-arm valve mechanism, intake valve (exhaust valve) 10 is arranged to across an intake (exhaust) port P provided to a cylinder head 11. Mounted on the outer circumference of a stem end portion of the valve 10 are a cotter 12*a* and a spring retainer 12*b*. A valve spring 14 is interposed between a spring seat 11*a* and the spring retainer 12*b* to be urged in a valve closing direction (upward in FIG. 1). The reference character 11*b* denotes a cylindrical valve sliding guide. The reference character 10*a* denotes a tapered valve seat face formed on the outer circumference of a head of the valve 10. The reference character 11*c* denotes a tapered seat insert corresponding to the valve seat 10*a*, formed on the periphery of an opening of the intake (exhaust) port to a combustion chamber S.

The reference numeral 16 denotes a rocker arm. One end of the rocker arm 16 abuts against the stem end of the valve 10. A socket portion 18 is formed on the other end of the rocked arm 16. The socket portion 18 engages with a pivot portion 24*a* at the tip end of the plunger 24 in the mechanical lash adjuster 20.

In the middle of the longitudinal direction of the rocker arm 16, a roller 17*b* supported by a roller shaft 17*a* is mounted. Against the roller 17*b*, a cam 19*a* attached to a camshaft 19 abuts.

The mechanical lash adjuster 20 includes a cylindrical housing 22 serving as a plunger engaging member inserted in a bore 13 extending in the vertical direction and mounted on the cylinder head 11, a plunger 24 arranged in the housing 22, and a plunger spring 26 loaded in the plunger 24 in the vertical direction. A female thread 23 is formed inside of the housing 22 and a male thread 25 is formed outside of the plunger. The female thread 23 and the male thread 25 engage with each other to form a thread engagement portion. The mechanical lash adjuster 20 is retained and urged by the plunger spring 26 in a direction in which the plunger 24 is extending from the housing 22 (upward in FIG. 1).

The reference character 27*a* denotes a disc-shaped spring seat plate housed in the lower end portion side of the housing 22. The reference character 27*b* denotes a C-ring fixing the spring seat plate 27*a* to the housing 22.

In other words, the plunger 24 on which a pressing force of the cam 19*a* acts as an axial load and the housing 22 serving as the plunger engaging member engage with each other in the axial direction via the thread engagement portion (the male thread 25 on the plunger 24 side and the female thread 23 on the housing 22 side).

It should be noted that the housing 22 is inserted into the bore 13 in such a way as to abut against the bottom surface of the bore 13 at the lower end portion but not is press-fitted into the bore 13 (that is, means for actively preventing rotation are provided). However, at the time where the axial load in the direction pressing down the plunger 24 acts on the plunger via the rocker arm 16, a friction torque generated between the lower end portion of the housing 22 and the bottom surface of the bore 13 prevents the housing 22 from rotating with respect to the bore 13. That is, the housing 22 is retained so as not to rotate with respect to the bore 13 in virtue of the friction torque generated between the housing 22 and the bottom surface of the bore 13.

Further, in the state where a base circle 19*a*1 of the cam 19 abuts against (the roller 17*b*) of the rocker arm 16 (in the state where the cam nose 19*a*3 does not abut against the roller 17*b* of the rocker arm 16), an urging force of the plunger spring 26 and a frictional force balanced with the urging force and generated on the thread engagement portion (thread surface) acts on the plunger 24.

Figure 2:
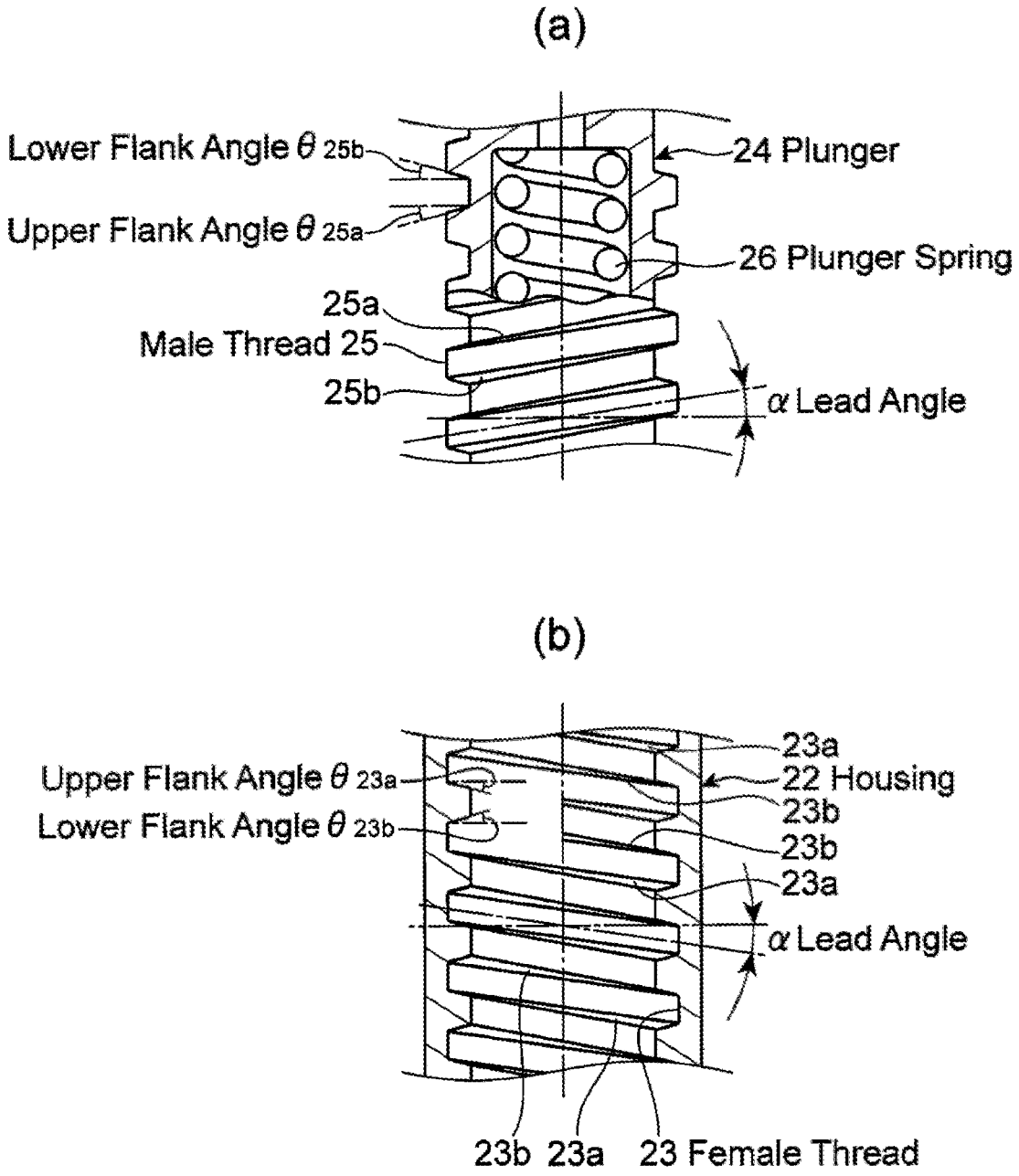
FIG. 2 are views of a main part of the mechanical lash adjuster according to the first embodiment, including (a) a view of lead and flank angles of a thread ridge of a male thread formed on a plunger and (b) a view of lead and flank angles of a thread ridge of a female thread formed on a housing.

In addition, as illustrated in enlarged view of FIGS. 2(*a*) and 2(*b*), the male thread 25 on the plunger 24 side and female thread 23 on the housing 22 side configures the thread engagement portion between the plunger 24 and the housing 22 and each is made up of a trapezoidal thread. A lead angle $\alpha$ of the thread ridge of the male thread 25 (female thread 23) and an upper flank angle $\theta$25*a* ($\theta$23*a*) and a lower flank angle $\theta$25*b* ($\theta$23*b*) of the thread ridge of the male thread 25 (female thread 23) are set to predetermined value, for example, the lead angle $\alpha$=10 degrees, the upper flank angle $\theta$25*a*, $\theta$23*a*=10 degrees, and the lower flank angle $\theta$25*b*, $\theta$23*b*=10 degrees. Accordingly, when the axial load acts on the plunger 24 in either of extension and contraction directions, the threads are made self-sustaining (the thread engagement portion become relatively immovable). However, when the lateral load acts on the plunger 24, the plunger 24 can slide and rotate at the thread engagement portion to move in the axial-load acting direction.

That is, the rocker arm 16 pressing the tip end of stem of the valve 10 in association with the rotation of the cam 19*a*, the valve 10 slides in the vertical direction so that the intake (exhaust) port P open/close with respect to the combustion chamber S. During the sliding, the plunger 24 on which the axial load acts is made immovable at the thread engagement portion, that is, the plunger 24 is restrained so as not to slide and rotate at the thread engagement portion (threads are made self-sustaining), so that the pivot portion 24*a* at the tip end of the plunger 24 functions (acts) as a fulcrum of the rocker arm 16 swinging in association with the rotation of the cam shaft 19.

Further, the rocker arm 16 swinging in association with the rotation of the cam 19*a* by utilizing the pivot portion 24*a* at the tip of the plunger 24 in the lash adjuster 20 as a fulcrum, the valve 10 reciprocate in the vertical direction. At that time, the lift amount of the valve 10 shows a chevron shape as in FIG. 5.

The cam 19*a* pressing (the roller 17*b* of) the rocker arm 16 causes the axial load acting on the plunger 24. However, the contact point of the cam nose 19*a*3 and (the roller 17*b* of) the rocker arm 16 moves on (the roller 17*b*) of the rocker arm 16 so as to change the pressing-force acting direction of the cam 19*a*, so that a lateral load also acts on the plunger as indicated by the reference characters T1, T2 of FIG. 5.

When the lateral load acts on the plunger 24, the plunger 24 swings in the lateral-load acting direction by an amount corresponding to the backlash of the thread engagement portion. That is, by the swing of the plunger 24 with respect to the housing 22 stopped rotating in the circumferential direction, the contact point of the male thread 25 with the female thread 23 moves in the circumferential direction along a flank face of the female thread. However, since the lateral load-acting direction does not coincide with the direction of the movement of the contact point, the movement of the contact point act as a moment to allow the plunger to slide and rotate at the thread engagement portion. Thereby, the plunger 24 moves in the axial-load acting direction while sliding and rotating, so as to cancel a valve clearance increasing/decreasing state.

Next, with reference to FIGS. 3, 4, detailed description will be made of the principle of the plunger 24 swinging in the lateral-load acting direction to generate the moment for sliding and rotating the plunger 24 in the thread engagement portion, thereby moving the plunger 24 in the lateral-load acting direction while sliding and rotating.

Figure 3:
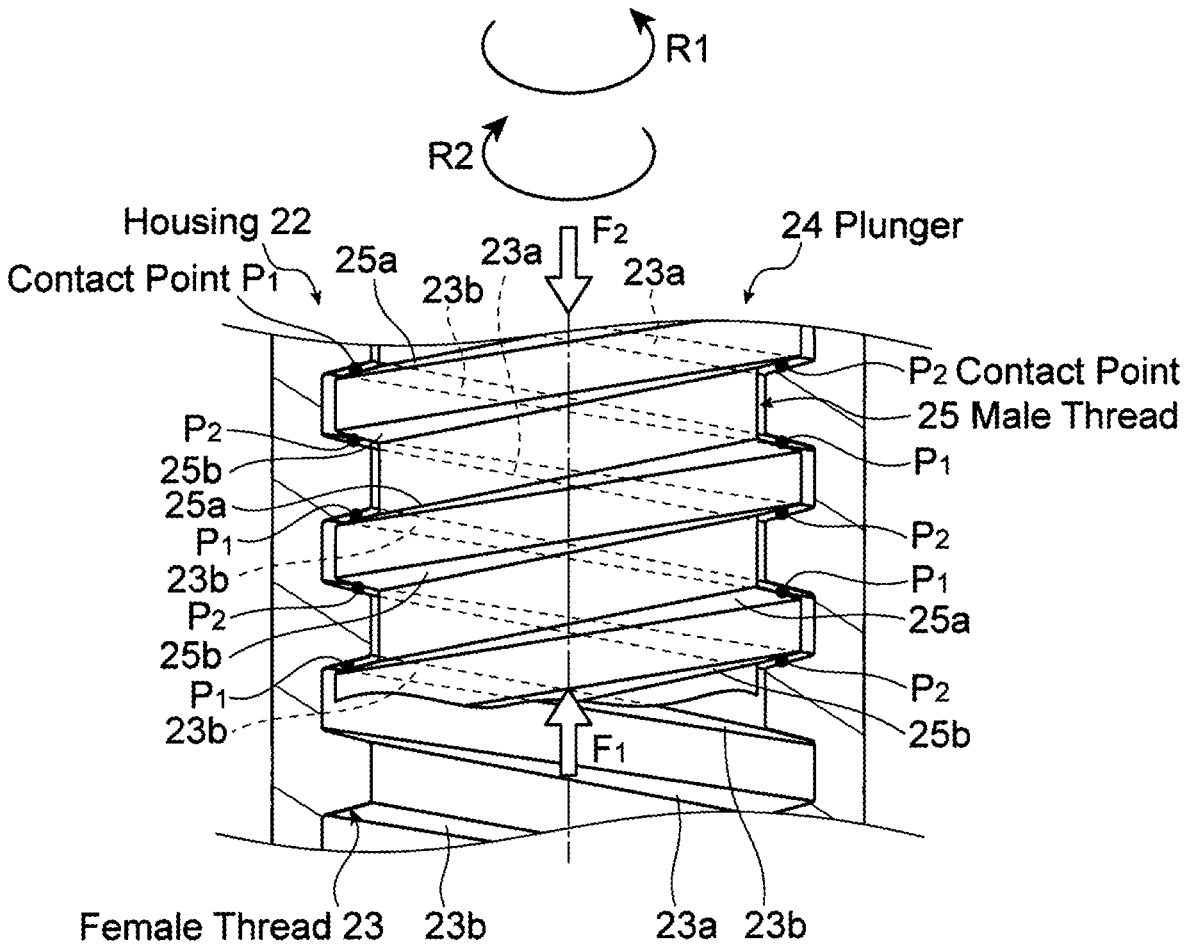
FIG. 3 is an explanatory view for explaining a principle of the plunger sliding and rotating in a thread engagement portion and moving in an axial-load acting direction due to swinging of the plunger.

For example, as indicated by the reference character F1 in FIG. 3, when the axial load acts upward on the plunger 24 (e.g., in a form in which only the urging force of the plunger spring 26 acts thereon), an upper flank face 25*a* of the male thread 25 comes into contact with a lower flank face 23*b* of the female thread 23. The contact point is denoted by the reference character P1. In FIG. 3, when a lateral load T acts on the pivot portion 24*a* (see FIG. 1) at the tip of the plunger 24 arranged in the vertical direction from the near side toward the far side on the plane of FIG. 3, the pivot portion 24*a* at the tip of the plunger 24 swings from the near side toward the far side on the plane of FIG. 3 by using a lower end portion of the thread engagement portion, i.e., a plunger lower end portion 24*b* (see FIGS. 1, 4) put thread engagement with the housing-side female thread 23 as a fulcrum.

When the thread engagement portion (male thread 25) is a normal right-hand thread, in the left half of the male thread 25 (in the left half of FIG. 3), the upper flank face 25*a* of the male thread 25 operates to butt the lower flank face 23*b* of the female thread 23 extending diagonally downward while turning clockwise. And in the right half of the male thread 25 (the right half of FIG. 3), the upper flank face 25*a* of the male thread 25 operates in a direction away from the lower flank face 23*b* of the female thread 23 extending diagonally upward while turning counter-clockwise.

The housing-side female thread 23 is retained so as not to rotate in the circumferential direction of the thread engagement portion. Thus, at the contact point P1 of the upper flank face 25*a* in the left half of the male thread 25 with the lower flank face 23*b* of the female thread 23 moves along the lower flank face 23*b* of the female thread 23 extending diagonally upward while turning counter-clockwise.

Since the lateral-load T acting direction (input direction) does not coincide with the direction of the movement of the contact point P1, the movement of the contact point P1 acts as a moment causing the plunger 24 to slide and rotate at the thread engagement portion in the counter-clockwise direction R1 of FIG. 3, thereby the plunger 24 slides and rotates to move in the acting direction of the axial load F1 (upward) by an amount corresponding to the backlash.

Figure 4:
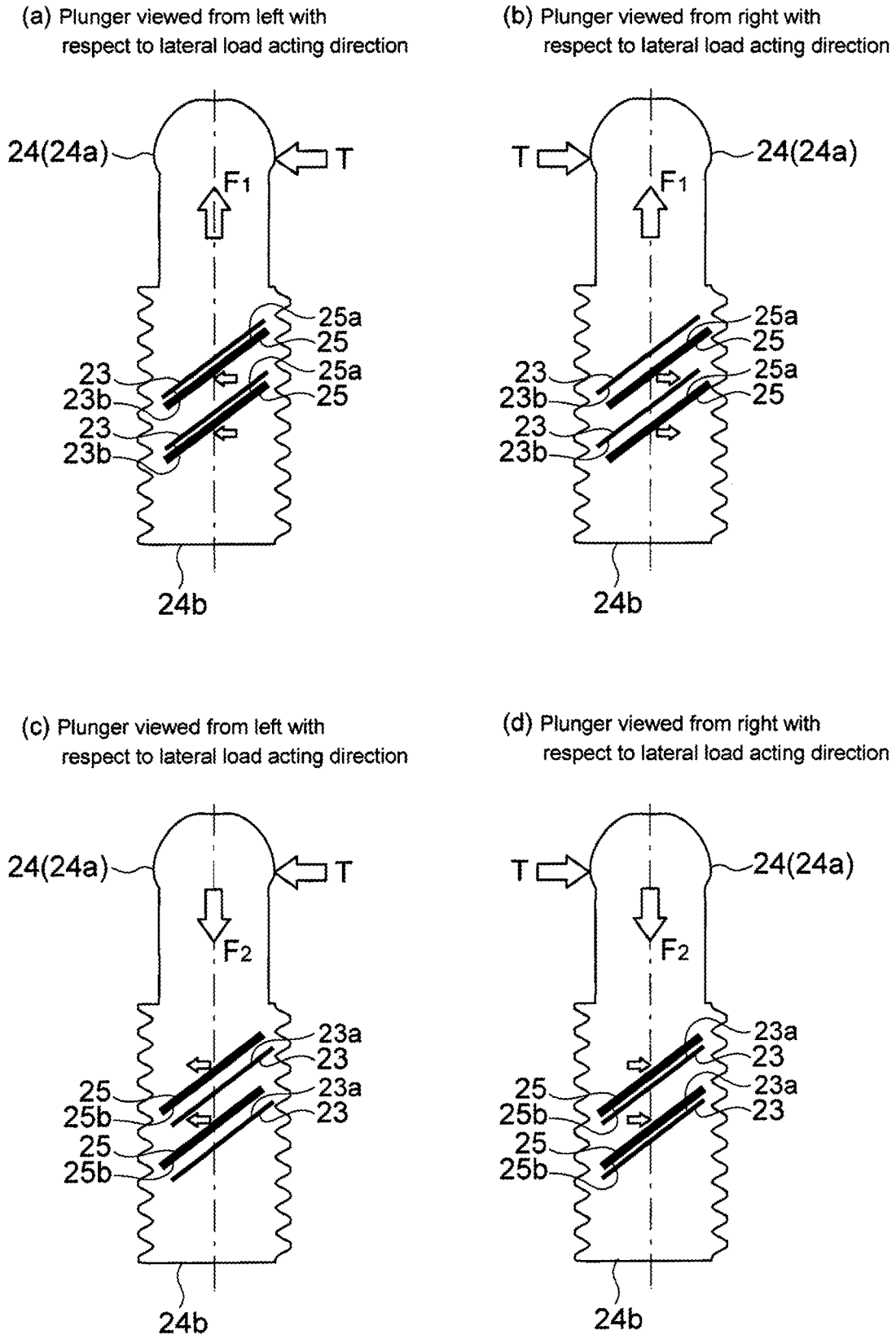
FIG. 4 is diagrams (a) to (d) for explaining motions of the plunger when a lateral load is input to (acts on) an upper end portion of the plunger from the near side toward the far side on the plane of the figure, including (a), (b) as the case in which the lateral load acts on the plunger while an axial load acts thereon in an extension direction and (c), (d) as the case in which the lateral load acts on the plunger while an axial load acts thereon in a contraction direction and showing (a), (c) as diagrams of the plunger viewed from the left with respect to the input (acting) direction of the lateral load and (b), (d) as diagrams of the plunger viewed from the right with respect to the input (acting) direction of the lateral load.

In other words, in the left half of the plunger 24 with respect to the lateral load T input (acting) direction, as illustrated in FIG. 4(*a*), during the swing of the plunger 24, the upper flank face 25*a* of the male thread 25 abuts against the lower flank face 23*b* of the housing-side female thread 23 retained so as not to rotate in the circumferential direction, and thus can no longer operate (move leftward in FIG. 4(*a*)). On the other hand, in the right half of the plunger with respect to the lateral-load T input (acting) direction, as illustrated in FIG. 4(*b*), during the swing of the plunger 24, the upper flank face 25*a* of the male thread 25 operates in a direction away from the lower flank face 23*b* of the female thread 23, and thus can operate (moves rightward in FIG. 4(*b*)) without any restraint. Consequently, the plunger 24 slides and rotates at the counter-clockwise direction R1 by an amount corresponding to the backlash to move in the extension direction (upward).

For example, when the thread engagement portion (male thread 25) is a normal right-hand thread and the axial load F1 acts upward on the plunger 24, during the swing to the plunger 24 due to the lateral load T, the plunger 24 moves in the axial-load F1 acting direction (extension direction) while rotating always in the counter-clockwise direction R1.

In contrast, as indicated by an arrow F2 in FIG. 3, when the axial load acts down ward on the plunger 24 (e.g., in a form in which the urging force of the valve spring 14 acts on the plunger 24 via the rocker arm 16), the lower flank face 25*b* of the male thread 25 comes into contact with the upper flank face 23*a* of the female thread 23. The contact point is denoted by the reference character P2. When the lateral load T acts on the pivot portion 24*a* at the tip of the plunger 24 from the near side toward the far side on the plane of FIG. 3, the pivot portion 24*a* at the tip of the plunger 24 swings from the near side toward the far side on the plane of FIG. 3 by using the lower end portion (the plunger lower end portion) 24*b* of the thread engagement portion as a fulcrum.

When the thread engagement portion (male thread 25) is a normal right-hand thread, in the right half of the male thread 25 (the right half of FIG. 3), the lower flank face 25*b* of the male thread 25 operates to butt the upper flank face 23*a* of the female thread 23 extending diagonally upward while turning clockwise, and the lower flank face 25*b* of the male thread 25 in the left half of the male thread 25 (the left half of FIG. 3) operates in a direction away from the upper flank face 23*a* of the female thread 23 extending diagonally downward while turning clockwise.

Since, the housing-side female thread 23 is retained so as not to rotate in the circumferential direction of the thread engagement portion, at the contact point P2 of the lower flank face 25*b* in the right half of the plunger-side male thread 25 with the upper flank face 23*a* of the housing-side female thread 23 moves along the upper flank face 23*a* of the female thread 23 extending diagonally downward while turning clockwise.

Since the lateral-load T acting direction does not coincide with the direction of the movement of the contact point P2, the movement of the contact point P2 acts as a moment causing the plunger 24 to slide and rotate at the thread engagement portion in the clockwise direction R2. Thereby, the plunger 24 slides and rotates to move in the axial-load F2 acting direction (downward) by an amount corresponding to the backlash.

For example, when the thread engagement portion (male thread 25) is a normal right-hand thread and the axial load F2 acts downward on the plunger 24, during the swing of the plunger 24 due to the lateral load T, the plunger 24 moves in the axial-load F2 acting direction (contraction direction) while always rotating in the direction R2.

In other words, in the right half of the plunger 24 with respect to the lateral-load T input (acting) direction, as illustrated in FIG. 4(*d*), during the swing of the plunger 24 due to the lateral load T, the lower flank face 25*b* of the male thread 25 comes into contact with the upper flank face 23*a* of the female thread 23 and can no longer operate (move rightward in FIG. 4(*d*)). On the other hand, in the left half of the plunger 24 with respect to the lateral-load T input (acting) direction, as illustrated in FIG. 4(*c*), during the swing of the plunger 24 due to the lateral load T, the lower flank face 25*b* of the male thread 25 moves away from the upper flank face 23*a* of the female thread 23 and is no longer restrained (move leftward in FIG. 4(*c*)). Consequently, the lower flank face 25*b* of the male thread 25 receives the reaction force from the upper flank face 23*a* of the housing-side female thread 23, and the plunger 24 moves in the contraction direction (downward) while sliding and rotating in the direction R2 by an amount corresponding to the backlash.

As described above, when the lead and flank angles of the thread ridges of the "threads" forming the thread engagement portion are set to predetermined values (e.g., the lead angle $\alpha$=10 degrees, the upper flank angle $\theta$25*a*, $\theta$23*a*=10 degrees, and the lower flank angle $\theta$25*b*, $\theta$23*b*=10 degrees), the plunger 24 on which the axial load acts basically becomes relatively immovable in the thread engagement portion (the threads are made self-sustaining) and functions (acts) as a fulcrum of swing of the rocker arm 16, so that when the lateral load T acts on the plunger 24, the plunger 24 operates by an amount corresponding to the backlash of the thread engagement portion not only in the extension direction of the plunger 24 (the direction to decrease the valve clearance) but also in the contraction direction of the plunger 24 (the direction of increasing the valve clearance).

Figure 5:
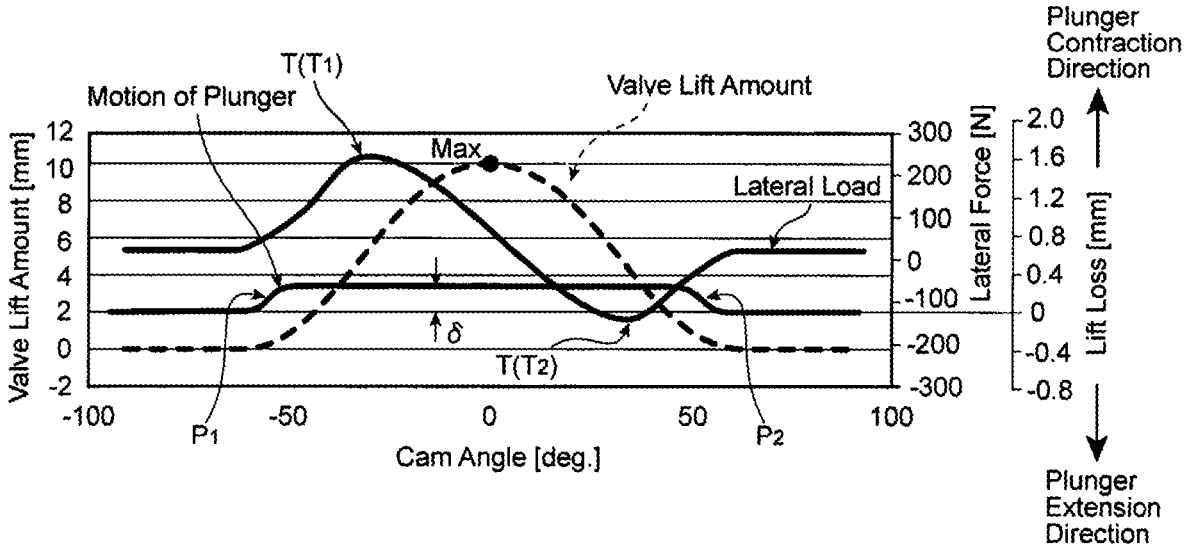
FIG. 5 is a diagram of a valve lift amount, the lateral load acting on the plunger, and a motion (lift loss) of the plunger when a rotation speed of an engine is low.

Further, FIG. 5 is a diagram of a valve lift amount, the lateral load acting on the plunger, and a motion (lift loss) of the plunger when a rotation speed of an engine is low. With reference to FIG. 5, the operation by the lash adjuster 20 of adjusting a valve clearance will be described.

As illustrated in FIGS. 1 and 5, when the cam shaft 19 (the cam 19*a*) rotates, the contact point of the cam 19*a* with (the roller 17*b* of) the rocker arm 16 is on the cam nose 19*a*3 at a cam angle from about −60 degrees to about +60 degrees and is on the base circle 19*a*1 of the cam 19*a* at the cum angle in the other range (about −60 degrees or less and about +60 degrees or more).

In other words, when the cam angle is from about −60 degrees to 0 degree, the contact point is located on one side surface of the cam nose 19*a*3 from the open-side ramp portion 19*a*2 to the cam top 19*a*4 of the cam. When the cam angle is from 0 degrees to about +60 degrees, the contact point is located on the other side surface of the cam nose 19*a*3 from the cam top 19*a*4 to the close-side ramp portion 19*a*2.

Specifically, first, when the contact point of the cam 19*a* with the rocker arm 16 is on the base circle 19*a*1 of the cam 19*a* (when the cam angle is −60 degrees or less), a predetermined reaction force (urging force) of the plunger spring 26 acts on the plunger 24. The urging force is balanced with the friction force generated on the thread engagement portion (thread surfaces) so that the plunger 24 does not move in the extension/contraction direction with the valve clearance (clearance between the cam 19*a* and the rocker arm 16) retained at zero.

Therefore, the plunger 24 becomes immovable with "threads made self-sustaining" in the thread engagement portion, and the lash adjuster 20 functions as the fulcrum of the swing of the rocker arm 16.

On the other hand, when the contact point of the rocker arm 16 with the cam 19*a* is located between the open-side ramp portion 19*a*2 of the cam and the close-side ramp portion 19*a*2 on the opposite side across the cam top 19*a*4 (when the cam angle of FIG. 5 is in the range from −60 degrees to +60 degrees), the pressing force due to the cam 19*a* acts as an axial load on the plunger 24 via the rocker arm 16. Therefore, the plunger 24 becomes immovable with "threads made self-sustaining" in the thread engagement portion so that the lash adjuster 20 functions as the fulcrum of the swing of the rocker arm 16.

That is, the axial load acts on the plunger 24 at all times independently of the position of the contact point of the rocker arm 16 with the cam 19*a*. Accordingly, the plunger 24 becomes immovable with "threads made self-sustaining" in the thread engagement portion, so that the lash adjuster 20 functions as the fulcrum of the swing of the rocker arm 16. For this reason, a lift amount of the valve 10 corresponding to one rotation of the cam 19*a* forms a mount shape with a maximum lift amount of about 10 mm as indicated by a broken line in FIG. 5. Although described in detailed later, because of a backlash present in the thread engagement portion between the plunger 24 and the housing 22, the lift amount of the valve 10 in FIG. 5 includes a lift loss $\delta$ (for example, about 0.2 mm) generated as the plunger 24 automatically slides and rotates to move in the contraction direction.

There exists a backlash in the thread engagement portion between the plunger 24 and the housing 22. Accordingly, when the pressing force from the cam 19*a* acts as the axial load on the plunger 24 via the rocker arm 16, i.e., when the contact point of (the roller 17*b* of) the rocker arm 16 with the cam 19*a* moves in association with the rotation of the cam 19*a* so as to change the pressing-force acting direction of the cam 19*a* with respect to (the roller 17*b* of) the rocker arm 16, the lateral loads T1, T2 of about 250 to 150 N act on the plunger 24 as illustrated in FIG. 5.

The operation of the lash adjuster 20 for adjusting the valve clearance generated in the valve operation mechanism can be described as follows.

The positive valve clearance in the valve mechanism is manifested as a gap between the cam 19*a* and the roller 17*b* of the rocker arm 16 when the contact point of the rocker arm 16 with the cam 19*a* is on the base circle 19*a*1 of the cam 19*a*. In this case, the urging force of the plunger spring 26 acts on the plunger 24. The urging force is balanced with the friction force generated on the thread engagement portion (thread surfaces) so that the threads of the thread engagement portion are retained in the self-sustaining state.

In this state, when the contact point (contact point with a gap) of the rocker arm 16 with the cam 19*a* shifts from the open-side ramp portion 19*a*2 to the cam nose 19*a*3, the lateral load T1 acts on the plunger 24 according to the shift of the contact point. In particular, the lateral load T1 (see FIG. 5) acts via the rocker arm 16 on the plunger 24 in the immovable state immediately before the gap between the cam 19*a* and the roller 17*b* disappears in association with the rotation of the cam 19*a* so that the pressing force of the cam 19*a* acts as the axial load, the plunger 24 moves in the extension direction that is the axial-load acting direction. As a result, the plunger 24 slides and rotates to push up the rocker arm 16, so that the positive clearance generated in the valve mechanism 1 is adjusted to zero.

Specifically, when the lateral load T1 (see FIG. 5) acts on the plunger 24 via the rocker arm 16, the plunger 24 swings by an amount corresponding to the backlash at the thread engagement portion between the female thread 23 and the male thread 25 in the lateral-load T1 acting direction by using the lower end portion 24*b* of the plunger 24 as a fulcrum. And, the swing of the plunger 24 with respect to the housing 22 which is stopped rotating in the circumferential direction causes the movement of the contact point P1 (see FIG. 3) of the male thread 25 with the female thread 23 along the lower flank face 23*b* of the female thread in the circumferential direction. The movement of the contact point P1 acts as a moment causing the plunger 24 to slide and rotate at the thread engagement portion, thereby the plunger 24 slides and rotates to move in the axial-load acting direction (the acting direction of the urging force of the plunger spring 26, the plunger extension direction) to adjust the positive valve clearance to zero.

On the other hand, the negative valve clearance in the valve mechanism is manifested as an excessively small gap (negative gap) between the cam 19*a* and the roller 17*b* since the rocker arm 16 (the roller 17*b*) is pressed by the base circle 19*a*1 of the cam 19*a* due to the urging force of the valve spring 14 when the contact point of the rocker arm 16 with the cam 19*a* is on the base circle 19*a*1 of the cam 19*a*. In this case, although the urging force of the valve spring 14 acts on the plunger 24 via the rocker arm 16 as the axial load in the contraction direction, this urging force is balanced with the friction force generated on the thread engagement portion (thread surfaces) so that the threads of the thread engagement portion are retained in the self-sustaining state.

In this state, when the contact point (negative gap) of the rocker arm 16 with the cam 19*a* shifts from the open-side ramp portion 19*a*2 to the cam nose 19*a*3, the lateral load T1 acts on the plunger 24 according to the shift of the contact point. In particular. when this lateral load T1 acts via the cam 19*a* on the plunger 24 in the immovable state (see FIG. 5) in which only the urging force of the valve spring 14 acts as the axial load immediately before the pressing force of the cam 19*a* acts as the axial load, the plunger 24 moves in the contraction direction that is the axial-load acting direction while sliding and rotating. As a result of the cam 19*a* pushing down the rocker arm 16, the negative clearance generated in the valve mechanism is adjusted to zero.

Specifically, when the lateral load T1 (see FIG. 5) acts on the plunger 24 via the rocker arm 16, the plunger 24 swings by an amount corresponding to the backlash in the thread engagement portion between the female thread 23 and the male thread 25 in the lateral-load T1 acting direction of the lateral load by using the lower end portion 24*b* as the fulcrum. And, the swing of the plunger 24 with respect to the housing 22 which is stopped rotating in the circumferential direction causes a movement of the contact point P2 (see FIG. 3) of the male thread 25 with the female thread 23 along the upper flank face 23*a* of the female thread in the circumferential direction. The movement of the contact point P2 acts as a moment causing the plunger 24 to slide and rotate at the thread engagement portion. Thereby, the plunger 24 slides and rotates to move in the axial-load acting direction (the acting direction of the urging force of the valve spring 14), that is, the plunger contraction direction, to adjust the valve clearance to zero.

Hereinbefore, the operation of the lash adjuster 20 has been described that, while the contact point of the rocker arm 16 with the cam 19*a* shifts from the open-side ramp portion 19*a*2 to the cam nose 19*a*3, the action of the lateral load T1 on the plunger 24 of the lash adjuster 20 adjusts the positive (negative) valve clearance generated in the valve mechanism to zero.

Now, the operation of the lash adjuster 20 will be described. During the shift of the contact point of the rocker arm 16 with the cam 19*a* from the cam nose 19*a* to the close-side ramp 19*a*2, the lateral load T2 acts on the plunger 24 of the lash adjuster 20. This adjust the positive (negative) valve clearance generated in the valve mechanism to zero.

First, the case where the lateral load T2 of FIG. 5 acts on the plunger 24 and the positive valve clearance exists on the base circle 19*a*1 of the cam 19*a* will be described.

When the contact point of the rocker arm 16 with the cam 19*a* (the contact point with an inherent gap) shifts from the cam nose 19*a*3 to the close-side ramp portion 19*a*2, the lateral load T2 acts on the plunger 24 according to the shift of the contact point. Specifically, as the cam 19*a* rotates, the pressing force of the cam 19*a* against the roller 17*b* becomes weaker when the contact point of the cam 19*a* with the roller 17*b* comes closer to the close-side ramp 19*a*2 of the cam 19*a*, and a gap is generated between the cam 19*a* and the roller 17*b* (the inherent gap in the contact point is manifested) before the contact point shifts to the close-side ramp 19*a*2. In this state in which the pressing force of the cam 19*a* against the rocker arm 16 becomes weaker and the axial load acting on the plunger 24 (the reaction force of the valve spring 14) is almost eliminated immediately before the gap is generated (manifested), the lateral load T2 (see FIG. 5) acts on the plunger 24 according to the shift of the contact point of the rocker arm 16 with the cam 19*a*. That is, the lateral load T2 (see FIG. 5) acts via the rocker arm 16 on the plunger 24 on which the axial load acts in the extension direction due to the urging force of the plunger spring 26. Accordingly, the plunger 24 moves in the extension direction that is the axial-load acting direction. As a result, the plunger 24 pushes up the rocker arm 16 and the positive valve clearance on the base circle 19*a*1 of the cam 19*a* (positive valve clearance generated in the valve mechanism) is adjusted to zero.

On the other hand, the negative valve clearance in the valve mechanism is manifested as a form in which a gap is generated between the seat 10*a* and the seat insert 11*c* of the valve 10 when the valve 10 is in the state of closing the intake (exhaust) port P, i.e., when the contact point of the cam 19*a* with the rocker arm 16 is on the base circle 19*a*1 of the cam 19*a*. In this state, since the roller 17*b* of the rocker arm 16 is pressed against the cam 19*a* by the urging force of the valve spring 14, the urging force of the valve spring 14 acts on the plunger 24 of the lash adjuster 20 via the rocker arm 16 as the axial load in the contraction direction.

Therefore, when the lateral load T2 (see FIG. 5) acts via the rocker arm 16 on the plunger 24 on which the urging force of the valve spring 14 acts as the axial load in the contraction direction as the pressing force of the cam decreases immediately and before the contact point of the cam 19*a* with the rocker arm 16 shifts from the cam nose 19*a*3 to the close-side ramp portion 19*a*22, the plunger 24 moves in the contraction direction that is the axial-load acting direction, and the cam 19*a* pushes down the locker arm 16, so that the negative valve clearance generated in the valve mechanism is adjusted to zero.

If an engine is rapidly cooled after being stopped in a warmed state, the valve clearance may be put into an excessively small (negative) state due to a difference in thermal expansion coefficient between a cylinder head (aluminum alloy) and a valve (iron alloy) so that a valve seat of the valve may float from a valve seat insert. If the valve seat is worn away, the same thing happens (the valve clearance is put into the excessively small state and the face surface of the valve floats from the valve seat insert).

If the engine is started and driven in such an excessively small (negative) state of the valve clearance, the combustion chamber is not sealed and an appropriate output cannot be acquired.

However, in this embodiment, in such excessively small state of the valve clearance, the lateral load acts via the rocker arm 16 on the self-sustaining plunger 24 on which only the urging force of the valve spring 14 acts as the axial load immediately after the start of the lift of the valve or immediately before the end of the lift and, when the plunger 24 swings in the lateral-load acting direction, the contact point P2 moves in the thread engagement portion to generate the moment. Consequently, the plunger 24 moves in the plunger contraction direction that is the axial-load acting direction, i.e., in the direction of increasing the valve clearance, while sliding and rotating in the thread engagement portion, and the excessively small state of the valve clearance is canceled.

Therefore, when the engine is driven, the combustion chamber can reliably be sealed by the valve 10 and an appropriate output can be acquired.

Further, the rocker arm 16 swinging around the pivot portion 24*a* of the plunger as a fulcrum in association with the rotation of the cam 19*a* should make the valve obtain a predetermined lift amount. However, there is a backlash in the thread engagement portion between the plunger 24 and the housing 22 of the lash adjuster 20. So, during the descent operation of the valve in association with the rotation of the cam 19*a*, the plunger 24 automatically moves in a contraction direction to make the lift amount decrease so that a lift loss δ appears.

That is, during the shift of the contact point of the rocker arm 16 and the cam 19*a* from the open-side ramp portion 19*a*2 to the cam nose 19*a*3, as illustrated in FIGS. 1, 3, 4, 5, both the axial load and the lateral load act on the lash adjuster 20 without fail. When the lateral load T1 (see FIG. 5) acts, a direction in which the plunger 24 moves is determined depending on the axial-load acting direction. Specifically, when the contact point is located on the base circle 19*a*1 of the cam 19*a* (the cam angle is less than −60°), the urging force of the plunger spring 26 acts on the plunger 24 while a friction force balancing to the urging force is generated on the thread surface of the thread engagement portion. Accordingly, the plunger 24 is retained immovable without moving in the extension/contraction direction, so that the valve clearance (a gap between the cam 19*a* and the rocker arm 16) remains zero.

Then, when the contact point of the cam 19*a* shifts from the base circle 19*a*1 to the open-side ramp portion 19*a*2, a set load (the pressing force of the cam 19*a*, i.e., the urging force of the valve spring 14) F2 of the valve 10 suddenly acts on the plunger 24 as the axial load.

When the lateral load denoted by the reference character T1 in FIG. 5 acts on the plunger 24 via the rocker arm 16 while the axial load F2 in the contraction direction acts on the plunger 24, during the swing of the plunger 24, the plunger 24 slides and rotates at the thread engagement portion in the acting direction of the lateral load T1 so as to move in the contraction direction (upward in FIG. 5). Therefore, the socket portion 18 of the rocker arm 16 descends (the other end side of the rocker arm 16 ascends) by an amount corresponding to the movement amount of the plunger 24 in the contraction direction and the lift amount of the valve 10 decreases, resulting in the lift loss δ (see FIG. 5).

Since after the lift loss δ is generated, the plunger 24 can no longer swing, the lift amount of the valve 10 gradually increases until the contact point shifts to the top 19*a*4 of the cam nose 19*a*3. However, the lash adjuster 20 is retained in the contracted state and the lift loss δ is maintained as it is. While the cam 19*a* rotates and the lift amount of the valve 10 gradually decreases from the Max lift, the lateral load T2 (see FIG. 5) in a direction opposite to the lateral load T1 acts on the plunger 24 via the rocker arm 16. However, since the pressing force of the cam 19*a* (the urging force of the valve spring 14) is dominant in the axial load acting on the plunger 24, the lash adjuster 20 is kept in the contracted state regardless of the action of the lateral load T2. In other words, the value of the lateral load acting on the plunger is extremely small (almost no lateral load acts) in the vicinity of the Max lift, while the pressing force of the cam 19*a* (the urging force of the valve spring 14) is close to the maximum value. Therefore, the plunger 24 does not swing/slide and rotate so that the lash adjuster 20 is retained in the contracted state.

Then, when the contact point shift to the close-side ramp 19*a*2 of the cam 19*a*, the axial load (the pressing force of the cam 19*a*, i.e., the urging force of the valve spring 14)) acting on the plunger 24 decrease, so that the urging force by the plunger spring 26 acts as the axial load F1. Under this state where the direction in which the axial load acts is changed, when the lateral load T2 acts via the rocker arm 16, in other words, the lateral load T2 acts on the plunger 24 on which the urging force by the plunger spring 26 acts as the axial load F1, the plunger 24 which has been in the contracted state up to that time swings, slides and rotate to move in the axial-load F1 acting direction (extension direction), as illustrated in FIGS. 4(*a*), 4(*b*). As a result, the lift loss δ disappears.

That is, in the this embodiment, there exists a backlash in the thread engagement portion between the plunger 24 and the housing 22 in the lash adjuster. Accordingly, the lift loss δ is generated during the shift of the contact point of the rocker arm 16 with the cam 19*a* from the open-side ramp portion 19*a*2 to the cam nose 19*a*3. However, the lift loss δ automatically disappears during the shift of the contact point of the rocker arm 16 and the cam from the cam nose 19*a*3 to the close-side ramp 19*a*2.

Thus, in an automatic valve-clearance adjusting function of the lash adjuster 20, since in response to the fluctuation in one rotation of the cam the lash adjuster 20 shrink or extend the lift loss δ must generates in the valve operating system. If the lift loss δ generates in the valve operation system in the normal operation of the engine, it would show that the lash adjuster 20 can amend the fluctuation of the valve clearance between positive and negative.

Next, the second embodiment of the present invention will be described with reference to FIG. 6. In the first embodiment, the mechanical lash adjuster 20 for a rocker arm valve mechanism has been described. In this second embodiment, a mechanical lash adjuster 20A for a direct-acting valve mechanism will be described.

A valve 10 is an intake valve (exhaust valve) arranged to traverse the intake (exhaust) port (see the reference character P in FIG. 1) disposed in a cylinder head 11. A cotter 12*a* and spring retainer 12*b* are held on a stem end of the valve 10. A valve spring 14 is interposed between a spring seat face (see the reference character 11*a* in FIG. 1) and the spring retainer 12*b* so as to urge the valve 10 in a valve opening direction (upward in FIG. 6).

On the other hand, a cam 19*a* provided on the camshaft 19 is disposed directly above the valve 10. The mechanical lash adjuster 20A inserted in a vertically extending bore 13 is interposed between the cam 19*a* and (the cotter 12*a* of) the tip end of the valve 10.

Figure 6:
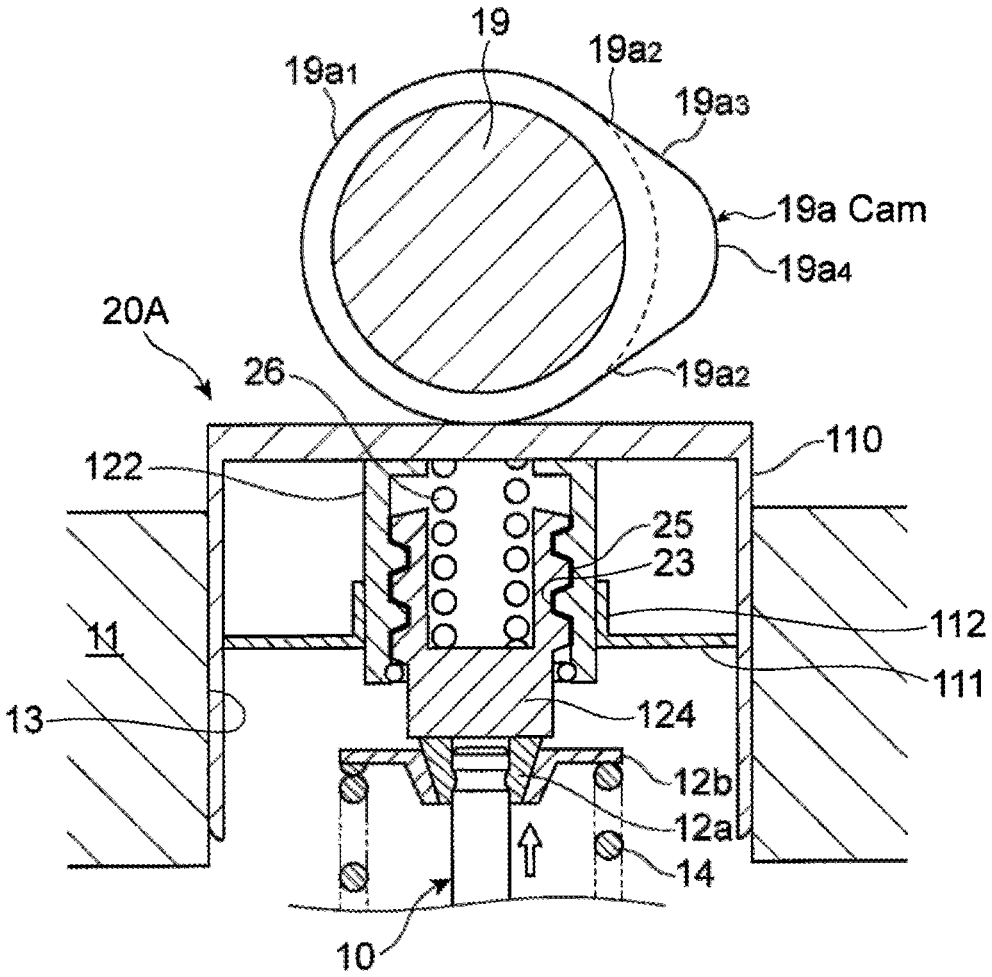
FIG. 6 is a longitudinal sectional view of a mechanical lash adjuster for direct-acting valve mechanism, illustrating a second embodiment in which the present invention is applied to a mechanical lash adjuster of direct-acting valve mechanism.

That is, the mechanical lash adjuster 20A includes a cylindrical bucket 110 which engages with the bore 13 formed on a cylinder head 11, the bucket 110 opening downward, a cylindrical housing 122 serving as a plunger engaging member, the housing 122 has a male thread 23 inside thereof, a cup-shaped plunger 124 opening downward and having a female thread 25 outside thereof, the plunger 124 arranged in the housing 122 by engaging the female thread 25 with the housing-122-side male thread 23, a plunger spring 26 interposed between the plunger 124 and a ceiling of the bucket 110 to urge the plunger 124 in a direction in which the plunger extends from the housing 122 (downward in FIG. 6, the opposite direction to a direction in which the urging force of the valve spring 14 acts).

A partition wall 111 extending in a disc shape is integrated with the inside of the bucket 110. A vertical cylindrical portion 112 is formed in the center of the partition wall 111 and the vertical cylindrical portion 112 is fixed to be integrated on the outer circumferences of the housing 122, so as to secure an mounting strength of the bucket 110 and the housing 122.

It should be noted that the bucket 110 is retained so as not to rotate in the circumferential direction with respect to the bore 13 by a rotation stopping means which is not shown. The bucket 110 (the lash adjuster 20A) slides in association with the rotation of the cam 19*a* only in the axial direction of the bore 13.

The lower end face of the plunger 124 abuts against the upper end face of the cotter 12*a* serving as an axial-load transmitting member attached to the tip end of the valve 10.

The angles (the lead and flank angles) of the thread ridge of the male thread 25 of the plunger 124 (the female thread 23 of the housing 122) is set to the same angles as the angles (the lead and flank angles) of the thread ridge of the male thread 23 of the plunger 24 (the female thread 23 of the housing 22) in the lash adjuster 20 according to the first embodiment, for example, the lead angle is set to 10 degrees, the flank angles are set to 10 degrees. Accordingly, the lash adjuster 20A is configured such that, when an axial load acts on the plunger 124 in either of extension and contraction directions, the threads are made self-sustaining (the threads are made relatively immovable), when the lateral load acts on the plunger 124, the plunger 124 is allowed to slides and rotates at the thread engagement portion to move in the axial-load acting direction.

The operation of the lash adjuster 20A when the cam 19*a* rotates is similar to the operation of the lash adjuster 20 in the above-described first embodiment illustrated in FIGS. 3, 4.

That is, since the lash adjuster 20A (bucket 110) can slide in the vertical direction with respect to the bore 13 provided in the cylinder head 11 in association with the rotation of the cam 19*a*, a micro gap is formed between the bore 13 and the bucket 110.

Accordingly, while a contact point of the cam 19*a* with the bucket 110 shifts from the cam base circle 19*a*1 to the cam nose 19*a*3, an unbalanced load in the left direction in FIG. 6 acts on the bucket 110 (housing 122) via the cam 19*a*. While the contact point shifts from the cam nose 19*a*3 to the base circle 19*a*1, an unbalanced load in the right direction in FIG. 6 acts on the bucket 110 (housing 122). In other words, accompanied with the shift of the contact point of the cam 19*a* and the bucket 110, a moment due to the unbalanced load acts on the bucket 110 (housing 122) to make the bucket 110 (housing 122) slightly incline with respect to the bore 13 so that the lateral load acts on the plunger 124.

When the lateral load acts on the plunger 124, the plunger 124 swings in the lateral-load acting direction (lateral direction in FIG. 6). Accompanied with the swing of the plunger 124, the contact point of the male thread 25 with the female thread 25 shifts along the flank face of the female thread 23. However, since the housing 122 is prevented from rotating, a moment for sliding and rotating the plunger 124 in the axial-load acting direction acts on the thread engagement portion, and the bucket 110 (housing 122) slightly inclines with respect to the bore 13 so that a lateral load acts on the plunger 124.

Therefore, when a positive valve clearance is generated in the valve mechanism, during the sift of the contact point of the cam 19*a* with the bucket 110 (the contact point in which the gape is generated) from the base circle 19*a*1 to the cam nose 19*a*3, the lateral load acts on the plunger 124 on which only an urging force of the plunger spring 26 acts as an axial load, immediately before a pressing force of the cam 19*a* acts on the plunger 124 as a axial load. Consequently, the plunger 124 slides and rotates to move in the axial-load acting direction (in the direction of the urging-force acting direction of the plunger spring 26, that is, the plunger 124 extending direction), so as to cancel the positive valve clearance generated in the valve mechanism.

Alternatively, when a negative valve clearance is generated in the valve mechanism, during the presence of the contact point of the cam 19*a* and the bucket 110 is on the base circle 19*a*1 of the cam 19*a*, the bucket 110 is pressed to the base circle 19*a*1 of the cam 19*a* by an urging force of the valve spring 14 so that an excessively small gap (negative gap) between the cam 19*a* and the bucket 110 appears. On this plunger 124, mainly the urging force of the valve spring 14 (to be exact, the difference between the urging force of the valve spring 14 and the urging force of the plunger spring 26) acts through a cotter 12*a* as an axial load in the contraction direction.

Then, during the shift of the contact point of the cam 19*a* with the bucket 110 from the base circle 19*a*1 to the cam nose 19*a*3, a lateral load acts on the plunger 124 on which mainly an urging force of the valve spring 14 (to be exact, the difference between the urging force of the valve spring 14 and the urging force of the plunger spring 26) acts as an axial load, immediately before a pressing force of the cam 19*a* acts on the plunger 124 as a axial load. Consequently, the plunger 124 slides and rotates to move in the axial-load acting direction (in the direction of the urging-force acting direction of the valve spring 14, i.e. the contraction direction of the plunger 124), so as to cancel the negative valve clearance generated in the valve mechanism.

Now, the third embodiment of the present invention will be described with reference to FIG. 7.

Figure 7:
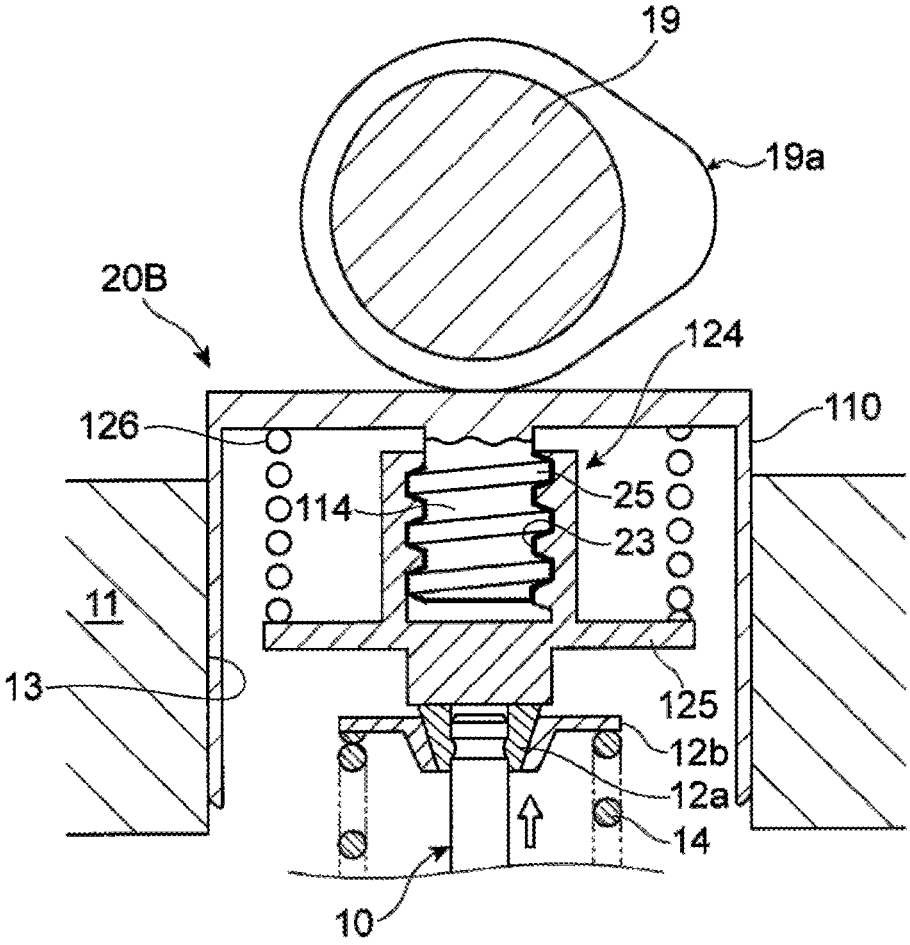
FIG. 7 is a longitudinal sectional view of a mechanical lash adjuster of direct-acting valve mechanism type of a third embodiment according to the present invention.

A mechanical lash adjuster 20B depicted in FIG. 7 illustrates a mechanical lash adjuster for a direct-acting valve mechanism likewise in the above second embodiment.

The lash adjuster 20A in the second embodiment is configured such that the female thread 23 formed on the inner circumference of the housing 122 which is integrated with the bucket 110 and the male thread 25 formed on the outer circumference of the cup plunger 124 are arranged to engage with each other.

On the other hand, the mechanical lash adjuster 20B of the third embodiment is configured such that a rod member 114 serving as a plunger engaging member is integrally formed on a ceiling of a bucket 110 to extend downward, a male thread 25 is formed on the outer circumference of the rod member 114, a female thread 23 is formed on the inner circumferential wall of the cup plunger 124 opening upward, and the male thread 25 of the rod member 114 and the female thread 23 of the plunger 124 engage with each other in the axial direction.

Further, the plunger 124 has a flange-shaped spring bracket 125. A plunger spring 126 is interposed between the spring bracket 125 and the ceiling of the bucket 110.

Since the other elements are the same as those of the lash adjuster 20A according to the second embodiment, the same reference characters are given thus duplicate description has been omitted.

Now, the fourth embodiment of the present invention will be described with reference to FIG. 8.

Figure 8:
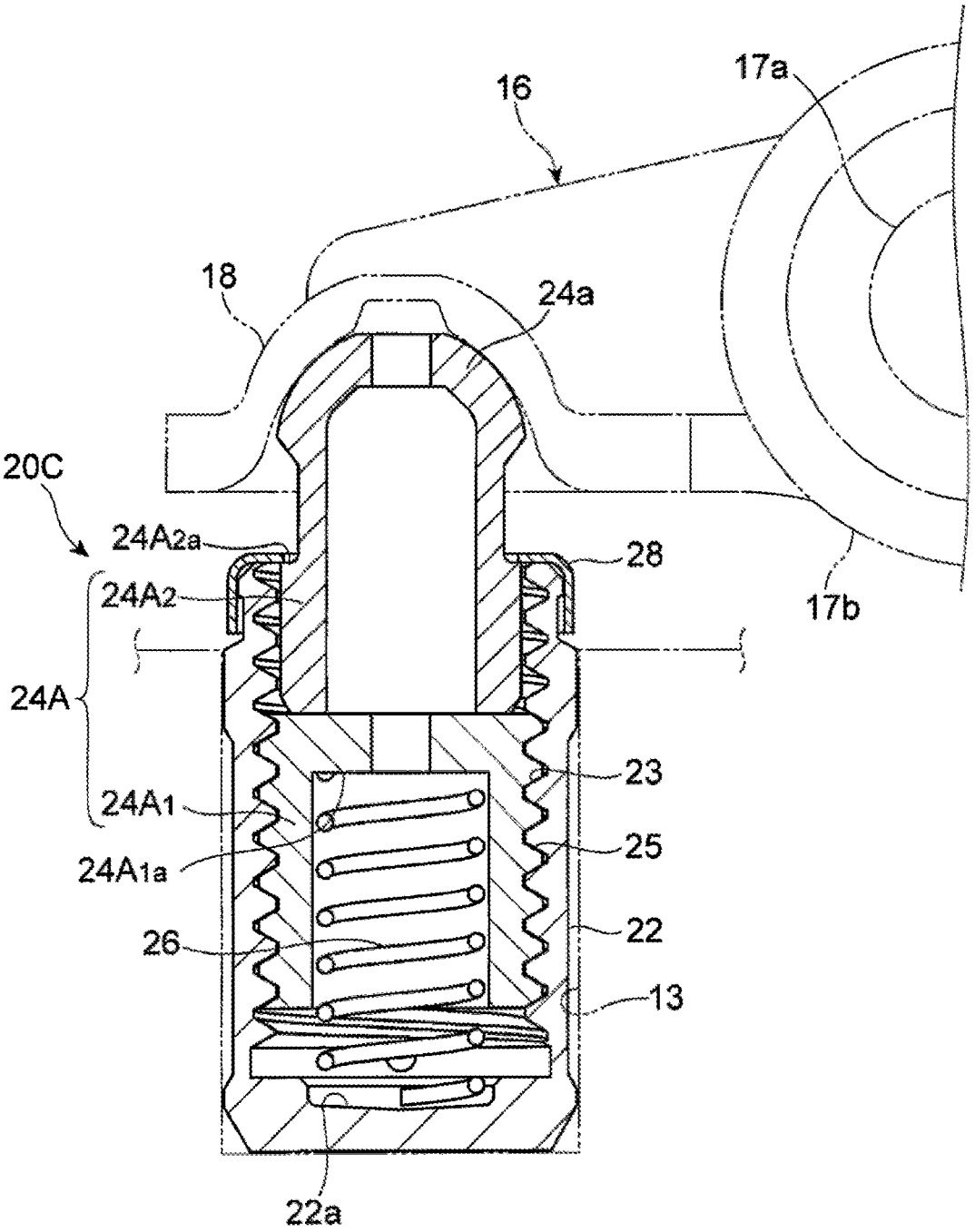
FIG. 8 is a longitudinal sectional view of a mechanical lash adjuster of rocker-arm valve mechanism.

A mechanical lash adjuster 20C depicted in FIG. 8 is, likewise the first embodiment, a lash adjuster for a rocker-arm valve mechanism and includes a plunger 24A arranged in a housing 22. The plunger 24A is divided into a plunger base 24A1 with a male thread 25 and a plunger tip 24A2 with a pivot portion 24*a*. Likewise in the first embodiment, the housing 22 is retained so as not to rotate in a circumferential direction in virtue of a friction torque generated between the lower end of the housing 22 and the bottom surface of the bore 13.

Specifically, the plunger base end 24A1 has the male thread 25 on the outer circumference, the male thread 25 engaging with the female thread 23 of the housing 22. The plunger base end 24A1 is formed in a cup shape opening downward and arranged in the lower position in the housing 22. The male thread 25 and the female thread 23 are triangle screws having equal flank angles. Angles of the thread ridge of the male thread 25 (female thread 23) forming a thread engagement portion are, likewise in the first, second, third embodiments, set to the predetermined values (for example, lead angel $\alpha$=10 degrees, upper and lower flank angles are 10 degrees). A plunger spring 26 is interposed between the inner surface 24A1*a* of the ceiling 24A1*a* of the plunger base end 24A1 and the bottom inner surface 22*a* of the housing 22, so as to urge the plunger base 24A1 upward.

On the other hand, the plunger tip 24A2 is formed in a cylindrical shape opening downward and has the pivot portion 24*a* at the upper end thereof. A step 24A2*a* formed on the outer circumference of the plunger tip end potion 24A2 engages with an annular cap 28 mounted on the upper end opening of the housing 22 so that the plunger tip 24A2 is retained. Thus, by the plunger spring 26, the plunger base 24A1 and the plunger tip 24A2 are retained to be in a pressure fitted condition in the axial direction, and the plunger 24A (the plunger tip 24A2) is urged to be retained in an upward direction in which the plunger 24A (the plunger tip 24A2) protruding from the housing (extension direction).

In the lash adjuster 20C, for example, a lead angle of thread ridge of the male thread 25 in the plunger base 24A1 (the female thread 23 of the housing 22) is set to 10 degrees and an upper (lower) flank angle of thread ridge of the male thread 25 (female thread 23) is set to 10 degrees. When an axial load acts on the plunger 24A (the plunger base 24A1) in either of extension and contraction directions, the threads are made self-sustaining (a thread engagement portion become relatively immovable). However, when a lateral load acts on the plunger 24A, the plunger 24A is allowed to slide and rotate at the thread engagement portion to move in the axial-load acting direction.

Since the other elements are the same as those of the lash adjuster 20 according to the first embodiment, the same reference numerals are given thus duplicate description has been omitted.

Since operation of the lash adjuster 20C is the same as that of the lash adjuster 20 according to the first embodiment (see FIGS. 3, 4), duplicate description has been omitted.

It should be noted that, though in the above first to fourth embodiments, the angles of the male thread 25 (the female thread 23) forming the thread engagement portion is set as the lead angle is 10 degree, the flank angles (upper and lower flank angle) are 10 degrees, the lead angle may be set in the range less than 15 degrees and the flank angles may be set in the range of 5 to 60 degrees.

In other words, the lead and flank angles of thread ridges of the "threads" forming the thread engagement portion determine a substantial friction angle of the thread engagement portion. However, if the lead angle is 15 degrees or more, when an axial load acts on the plunger, the plunger 24 slides and rotates at the thread engagement portion so that it is difficult to "reliably make threads self-sustaining" by the friction torque generated in the thread engagement portion. By contrast, when the lead angle is less than 15 degrees, the plunger 24 on which an axial load acts on does not slide and rotate at the thread engagement portion, so that the threads are made self-sustaining by the friction torque generated in the thread engagement portion.

Further, if the flank angles are less than 5 degrees, the threads fall into a category of a square screw having a small substantial friction angle. This makes changing the flank angle meaningless and highly-accurate machining without influence of a lead error, etc. difficult. On the other hand, even when the thread has a large lead angle generally not to "make the thread self-sustaining, in combination with a large flank angle, the substantial friction angle of the thread engagement portion becomes large so that the thread functions as a self-sustaining thread. However, if the flank angle exceeds 60 degrees, although the "thread" is easily machined, an extremely large substantial friction angle leads to a considerable influence of lubrication oil and increases a lift loss during operation of the engine so that the thread cannot practically be used. Namely, it becomes meaningless to utilize the flank angles as adjusting parameter.

Therefore, it is desirable to set the lead and flank angles of the thread ridges of the "threads" forming the thread engagement portion respectively in the range of less than 15 degrees and in the range of 5 to 60 degrees such that the threads are reliably made self-sustaining, that is, the thread engagement portion is made relatively immovable when an axial load acts on the plunger in either of the extension and contraction directions. By the way, the thread engagement portion between a general bolt and nut mainly for fastening has a lead angle of 2 to 3 degrees in the thread ridge. By contrast, it is desirable that the thread engagement portion between the plunger and the plunger engaging member forming the lash adjuster used in the same way as a feed screw have a lead angle as about three to four times large as the lead angle of the thread engagement portion between the bolt and nut for fastening (2 to 3 degrees).

A particular method for setting the lead and flank angles of thread ridge of the thread engagement portion includes firstly setting a required backlash in the thread engagement portion and a lead angle $\alpha$ of the "thread ridge" based on a lift loss $\delta$ of the valve generated during engine operation and then, setting the flank angles $\theta$. Since the larger (smaller) the flank angles $\theta$ are, the more easily (hardly) the plunger slide in the thread engagement portion, the flank angles $\theta$ are set as appropriate in order to finely adjust a timing of sliding rotation of the plunger 24 in the thread engagement portion or a slidability.

Generally, a large backlash of the thread engagement portion increases the lift loss $\delta$ generated in the engine operation so that the ramp portion 19*a*2 of the cam 19*a* does not function, thereby generating abnormal noise. This causes a big problem. So, it is desirable that the backlash be small. On the other hand, it is desirable that the backlash be large to some extent, since the extension/contraction speed of the plunger 24 (the amount that the plunger 24 extent or shrinks while the cam rotates once) increases as the backlash increases. When the female thread 23 and the male thread 25 is assembled, the larger the backlash is, the easier the assembling is.

For this reason, suitable backlash amount in the thread engagement portion is determined experimentally.

Specifically, the backlash is set by actually measuring the lift loss $\delta$ and the maximum speed at which the lash adjuster 20 extends and contracts when the lash adjuster 20 is operated in the practical engine. In detail, the backlash is set such that the lift loss $\delta$ (the amount of extension and contraction of the valve 10 due to an axial load and lateral load acting on the valve 10 during a valve lift in one rotation of the cam 19*a*) during normal operation does not exceed the ramp 19*a*2 (is within the range in which the ramp 19*a*2 of the cam 19*a* can function). Since it is preferable that adjusting speed of the valve clearance by the lash adjuster (extension and contraction amount of the plunger in the direction to cancel the valve clearance) should be as quick (great) as possible, the optimum value of the backlash is determined on the basis of the value of the lift loss δ and the extension and contraction amount of the plunger 24 (the maximum speed of the extension and contraction).

In the above first to fourth embodiments, the male thread 25 (the female thread 23) is a trapezoid screw thread or triangle screw thread having equal flank angles (i.e. the upper and lower flank angles are the same). However, the male thread 25 (the female thread 23) may be a trapezoid screw thread or triangle screw thread having unequal flank angles that an upper and lower flank angles are different from each other.

Further, in the above first, second, and fourth embodiments, the male thread 25 of the plunger 24, 124, 24A (24A1) and the female thread 23 of the housing 22, 122, in the third embodiments, the male thread 25 of the rod member 114 and the female thread 23 of the plunger 124 are single threaded screws each having a single lead. However, these may be multiple-threaded screws each having a plurality of leads, such as double-threaded screws or triple-threaded screws.

Multiple-threaded screws having a plurality of leads juxtaposed at equal intervals in the axial direction can increase the pitch of the leads as compared with a single-threaded screw having a single lead.

Accordingly, in the case of a multiple-threaded screw, considering the number of the threads in designing angles (a lead and flank angles) of the thread ridge of the "thread," can expand a settable range of desired angles (lead and flank angles) of the "threads."

Further, with the multiple-threaded screw, a bearing stress generated in the thread engagement portion decreases with respect to the axial load acting on the plunger, accordingly, the "threads" is less prone to wear. Therefore, it is possible to provide a mechanical lash adjuster particularly effective for a valve mechanism in which a large axial load acts on the plunger.

In the above embodiments, an effective diameter of the female thread of the plunger and an effective diameter of the female thread of the plunger engaging member are constant in the axial direction, thus the backlash of the thread engaging portion, i.e. a backlash between the plunger-side male thread 25 and the plunger-engaging-member-side female thread 23 is constant in the axial direction. However, as illustrated in FIGS. 9(*a*), 9(*b*) and 10, the lush adjuster 24 may be configured such that the backlash of the thread engagement portion changes continuously or stepwise.

Figure 9:
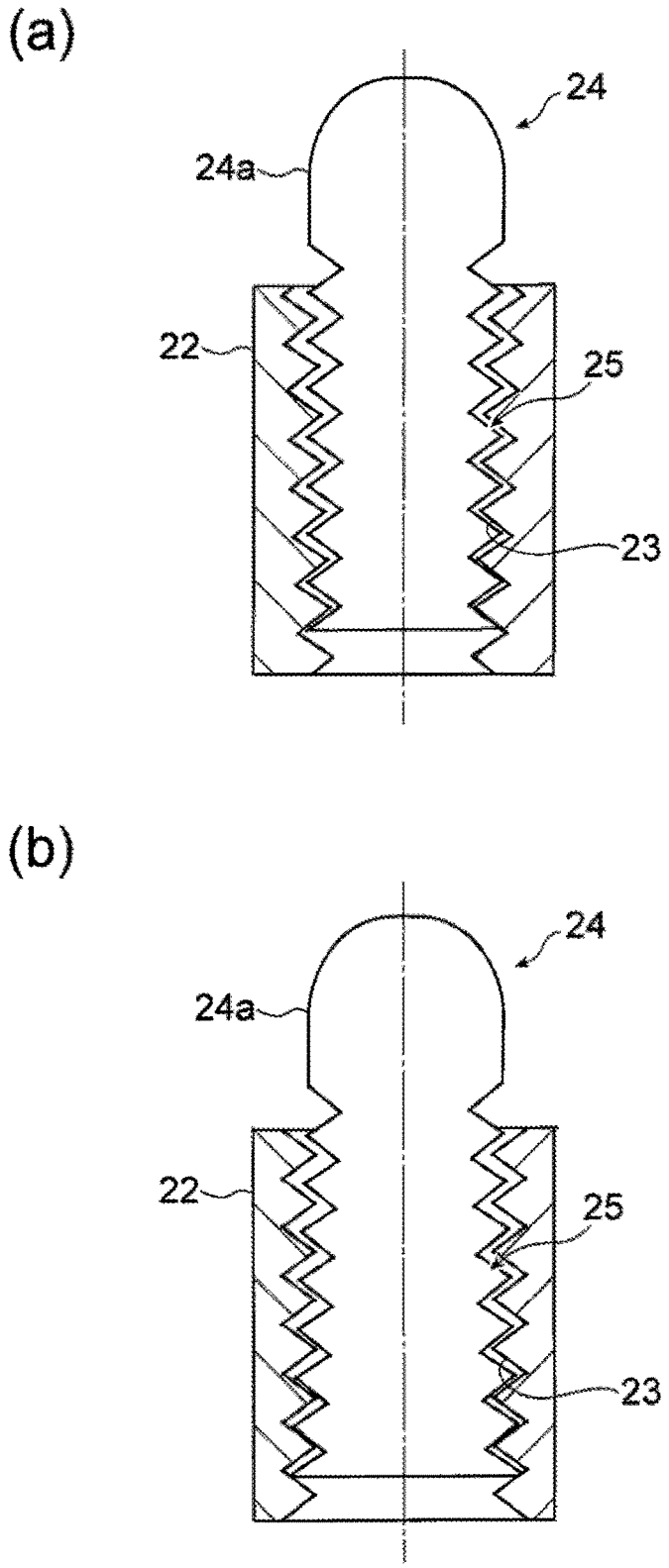
FIGS. 9(*a*) and 9(*b*) are longitudinal sectional views of mechanical lash adjusters of other embodiments according to the present invention.
Figure 10:
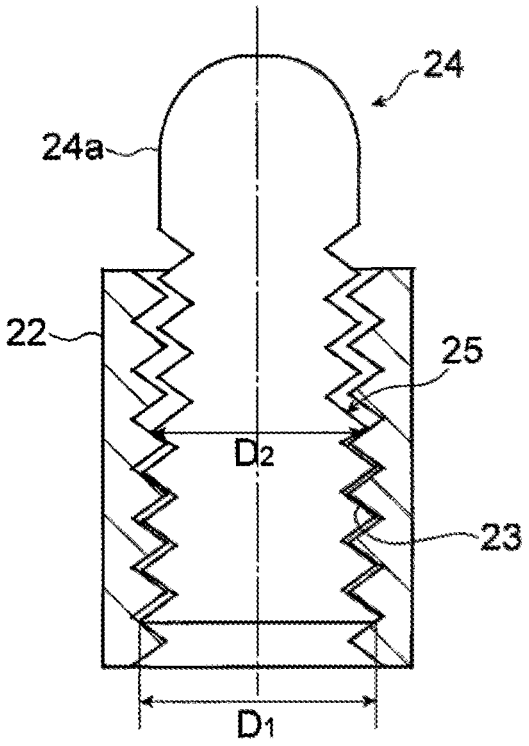
FIG. 10 is a longitudinal sectional view of a mechanical lash adjuster of still another embodiment according to the present invention.
Figure 11:
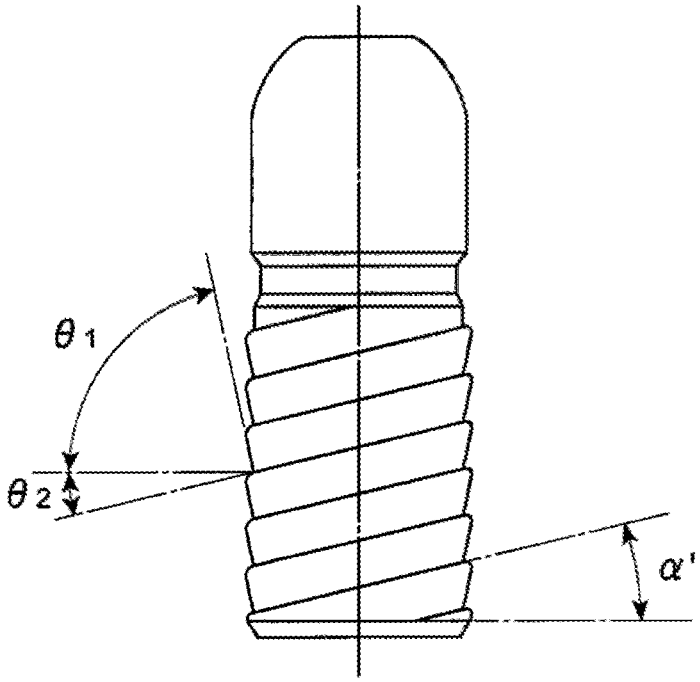
FIG. 11 is an enlarged side view of a pivot member which is a main part of a conventional mechanical lash adjuster.

That is, FIGS. 9(*a*), 9(*b*) are longitudinal section views of mechanical lash adjusters each having a structure that a backlash of a thread engagement portion varies continuously in the axial direction. FIG. 10 is a longitudinal section view of a mechanical lash adjuster having a structure that a backlash of a thread engagement portion varies stepwise in the axial direction.

Specifically, in FIG. 9(*a*), the effective diameter of the male thread 25 of the plunger 24 is constant in the axial direction while the plunger engaging member (housing 22) is formed in a tapered shape in which the effective diameter of the female thread 23 of the plunger engaging member becomes larger as it goes upward in the axial direction (becomes smaller as it goes downward). Thus, the backlash of the thread engagement portion (the backlash between the male thread 25 and the female thread 23) is set small in the axial direction and large in the lateral direction (in the radial direction).

On the other hand, in FIG. 9(*b*), the effective diameter of the female thread 23 of the plunger engaging member (housing 22) is constant in the axial direction while the plunger 24 is formed in a tapered shape in which the effective diameter of the male thread 25 of the plunger 24 becomes larger as it goes downward in the axial direction (becomes smaller as it goes upward) so that the backlash of the thread engagement portion (the backlash between the male thread 25 and the female thread 23) is set small in the axial direction and large in the lateral direction (in the radial direction).

Further, in FIG. 10, the effective diameter of the female thread 23 of the plunger engaging member (housing 22) is constant in the axial direction while the plunger 24 is formed in two steps, that is, the effective diameter of the male thread 25 of the plunger 24 is larger in the lower side in the axial direction and smaller in the upper side.

Specifically, the effective diameter D1 on the axially lower side of the male thread 25 of the plunger 24 is formed to be larger than the effective diameter D2 on the axially upper side so that the backlash of the thread engagement portion (the backlash between the male thread 25 and the female thread 23) is set small in the axial direction and the large in the lateral direction (in the radial direction).

In other words, in the lash adjusters illustrated in FIGS. 9(*a*), 9(*b*), and 10, since the backlash of the thread engagement portion in the axial direction is small, the lift loss of the valve 10 can be decreased. Further, since the backlash of the thread engagement portion in the lateral direction is large, the swing amount of the plunger 24 with respect to the lateral load acting on the plunger 24 is large so that a moment generated in the thread engagement portion accompanied with the movement of the contact point in the thread engagement portion (between the male thread 25 and the female thread 23) is large. Therefore, the plunger 24 smoothly slides and rotates at the thread engagement portion to move in the axial-load acting direction to adjust the valve clearance generated in the valve mechanism to zero.

EXPLANATIONS OF LETTERS OR NUMERALS

10 valve
11 cylinder head
12*a* cotter
13 bore
14 valve spring
19*a* cam
19*a*1 base circle of cam
19*a*2 ramp portion of cam
19*a*3 cam nose
19*a*4 cam top
20, 20A, 20B, 20C mechanical lash adjuster
22, 122 housing serving as plunger engaging member
23 female thread
24, 124, 24A plunger
24*a* pivot portion
24*b* plunger lower end portion
24A1 plunger base
24A2 plunger tip
25 male thread
26, 126 plunger spring
114 rod member serving as plunger engaging member F1, F2 axial load acting on the plunger T, T1, T2 lateral load acting on the plunger α lead angle of a thread ridge θ23*a* upper flank angle of the thread ridge of the female thread θ23*b* lower flank angle of the thread ridge of the female thread θ25*a* upper flank angle of the thread ridge of the male thread θ25*b* lower flank angle of the thread ridge of the male thread

The invention claimed is:

1. A mechanical lash adjuster comprising:

a plunger on which a pressing force of a cam in a valve mechanism acts as an axial load;

a plunger engaging member put into thread engagement with the plunger in an axial direction to form a thread engagement portion, the plunger engaging member retained so as not to rotate in a circumferential direction of the thread engagement portion; and a plunger spring urging the plunger in an opposite direction to a direction in which a urging force of a valve spring acts;

the mechanical lash adjuster interposed between a stem end of a valve urged in a valve closing direction by the valve spring and the cam to adjust a valve clearance, wherein a lead angle and flank angles of thread ridges of threads forming the thread engagement portion are set such that when an axial load acts on the plunger in either of a plunger extension and a plunger contraction direction during engine operation, the plunger is prevented from sliding and rotating due to friction torque generated in the thread engagement portion so that the threads are made self-sustaining, and when a lateral load acts on the plunger during engine operation, the plunger is allowed to slide and rotate at the thread engagement portion to move in an axial-load acting direction.

2. The mechanical lash adjuster according to claim 1, wherein angles of the thread ridges of the threads forming the thread engagement portion is set so that the lead angle is smaller than 15 degrees, and the flank angles are in a range of 5 to 60 degrees.

3. The mechanical lash adjuster according to claim 2, wherein the thread engagement portion is configured such that a backlash of the thread engagement portion is constant in the axial direction of the plunger, or changes continuously or stepwise in the axial direction of the plunger.

4. The mechanical lash adjuster according to claim 1, wherein the thread engagement portion is configured such that a backlash of the thread engagement portion is constant in the axial direction of the plunger, or changes continuously or stepwise in the axial direction of the plunger.

* * * * *